US007055271B2

(12) United States Patent
Lutz et al.

(10) Patent No.: US 7,055,271 B2
(45) Date of Patent: Jun. 6, 2006

(54) ELECTRONIC DISPLAY MODULE HAVING A FOUR-POINT LATCHING SYSTEM FOR INCORPORATION INTO AN ELECTRONIC SIGN AND PROCESS

(75) Inventors: Robert James Lutz, Bruce, SD (US); Nathan Lane Nearman, Brookings, SD (US)

(73) Assignee: Daktronics, Inc., Brookings, SD (US)

( * ) Notice: Subject to any disclaimer, the term of this patent is extended or adjusted under 35 U.S.C. 154(b) by 71 days.

(21) Appl. No.: 10/688,304

(22) Filed: Oct. 17, 2003

(65) Prior Publication Data

US 2005/0081414 A1 Apr. 21, 2005

(51) Int. Cl.
*G09F 7/00* (2006.01)

(52) U.S. Cl. ..... 40/605; 40/452; 403/322.1; 403/322.4

(58) Field of Classification Search ..... 40/541, 40/564, 605, 452, 550, 573; 292/25, 51, 292/112; 403/322.1, 332.4, 332.3, 321; 74/25
See application file for complete search history.

(56) References Cited

U.S. PATENT DOCUMENTS 2,053,547 A * 9/1936 Austin ..... 70/123
3,594,761 A * 7/1971 Boesen et al. ..... 345/30
4,234,914 A * 11/1980 Boesen ..... 362/240
5,172,504 A * 12/1992 De Maat et al. ..... 40/605
5,268,828 A * 12/1993 Miura ..... 362/249
5,647,152 A * 7/1997 Miura ..... 40/541
5,692,855 A * 12/1997 Burton ..... 403/325
5,715,619 A * 2/1998 Polisois et al. ..... 40/452
6,154,945 A * 12/2000 Voelzke ..... 29/426.5
6,314,669 B1 * 11/2001 Tucker ..... 40/448
6,508,494 B1 * 1/2003 Reuter et al. ..... 292/51
6,729,054 B1 * 5/2004 VanderTuin ..... 40/452
2003/0217495 A1 * 11/2003 Nagamine et al. ..... 40/605

* cited by examiner

*Primary Examiner*—Gary C. Hoge
(74) *Attorney, Agent, or Firm*—Hugh D. Jaeger

(57) ABSTRACT

An electronic display module having a four-point latching system for incorporation into an electronic sign and process where more than one latch mechanism can be actuated simultaneously to deploy to engage the mounting panel assembly of an electronic sign. Gear operated actuating arms incorporated in an overcenter arrangement position latch in opposing latch mechanisms to position latch arms outwardly in a linear direction over a mounting panel assembly followed by pivotal latch positioning to rotationally engage the latch arms against the mounting panel assembly to secure the electronic display module to the mounting panel assembly.

42 Claims, 18 Drawing Sheets

ELECTRONIC DISPLAY MODULE HAVING A FOUR-POINT LATCHING SYSTEM FOR INCORPORATION INTO AN ELECTRONIC SIGN AND PROCESS

CROSS REFERENCES TO RELATED APPLICATIONS

None.

BACKGROUND OF THE INVENTION

1. Field of the Invention

The present invention pertains to electronic alphanumeric and graphic displays, and more particularly is for an electronic display module having a four-point latching system for incorporation into an electronic sign and process.

2. Description of the Prior Art

Prior art electronic display modules have often been secured to mounting panels or mounting channels and the like by labor-intensive fasteners requiring actuation of multiple individual fasteners such as screws, nuts, nut and bolt assemblies, and the like where numerous fastening operations occur during initial assembly or assembly in the field. Such fastening occurrences often require labor-intensive manipulation and installation of fastening devices which are not part of the structure of the electronic display module and as such may not be readily available at the installation site. Clearly what is needed is a construction to facilitate rapid installation or changeout of electronic display modules and which contains onboard fastening structure, such as is provided by the present invention.

SUMMARY OF THE INVENTION

The general purpose of the present invention is to provide an electronic display module having a four-point latching system for incorporation into an electronic sign and process.

According to one or more embodiments of the present invention, there is provided a latching system having four latches distributed at points or locations about an electronic display module wherein the major components, assemblies and other components include, but are not limited to, an LED display panel, a louver panel, a driver board, and a main housing having opposing mirror image-like latch mechanisms which are actuated by opposing actuator arms operated by an actuator gear disposed between the ends of the actuator arms.

Each of the latch mechanisms, having commonality of components and structure, includes a latch housing extending from a panel which extends across the main housing, a latch having opposing inboard and outboard latch arms extending therefrom and extending through outboard and inboard slots in the latch housing, opposing latch posts extending outwardly from the central region of the latch, an attachment fixture at one end of the latch, and a latch lock plate which secures to an open side of the main housing panel to assist in containing the latch within the latch housing and to assist in forming portions of slots located interior to the latch housing in which the opposing latch posts, and thus the latch, traverse in linear fashion. A linkage connects one end of the latch to one end of the actuating arm, and the relationship of the actuating arm to the latch is such that the actuating arm maintains a restricted or an unrestricted overcenter relationship to the latch. During initial latch transiting, such orientation is limited and constrained where the internal geometry of the latch housing and the latch lock plate causes the latch to maintain a non-rotated status when transiting to position the latch arms over a mounting panel assembly. At the end of transiting, it is then desirable to rotate the latch to engage the structure of the mounting panel assembly. Additional movement of the actuating arm in the same direction urges the attachment fixture at one end of the latch into a position which is unconstrained at the end of its travel, to be forced by the unrestricted overcenter force applied thereto by the linkage which then drives the attachment fixture of the latch into a recess in a guide body, thereby rotating the latch. Such latch rotation causes impingement of the latch arms with the mounting panel assembly to cause securement thereto. In actuality two latch mechanisms are activated by the gear actuator in common therebetween. Although a four-point latching system is described, it is to be appreciated that other numbers of latching mechanisms can be incorporated at other points of symmetric or non-symmetric latching mechanism locations.

One significant aspect and feature of the present invention is an electronic display module incorporating multiple latches to attach the electronic display module to a mounting panel assembly.

Still another significant aspect and feature of the present invention is an electronic display module having multiple latches having onboard self-contained latching mechanisms.

Another significant aspect and feature of the present invention is an electronic display module having multiple latches having opposing latch mechanisms which are operated by an actuator gear disposed between opposing actuator arms.

A still further significant aspect and feature of the present invention is an electronic display module having multiple latches where a guide body influences the deployment of a latch to allow restricted or unrestricted latch movement with respect to the overcenter relationship of the actuator arm to the latch.

A further significant aspect and feature of the present invention is an electronic display module having multiple latches incorporating an overcenter relationship of an actuator arm to a latch where during latch deployment the overcenter relationship is restricted and then unrestricted to cause the latch arms of a latch to be actuated in a linear straight direction over the structure of a mounting panel assembly followed by rotation of the latch to cause the latch arms to securingly impinge the structure of the mounting panel assembly.

A still further significant aspect and feature of the present invention is an electronic display module having multiple latches where the latch housings are integral to the main housing.

Having thus set forth significant aspects and features of embodiments of the present invention, it is the principal object of the present invention to provide an electronic display module having a four-point latching system for incorporation into an electronic sign and process.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
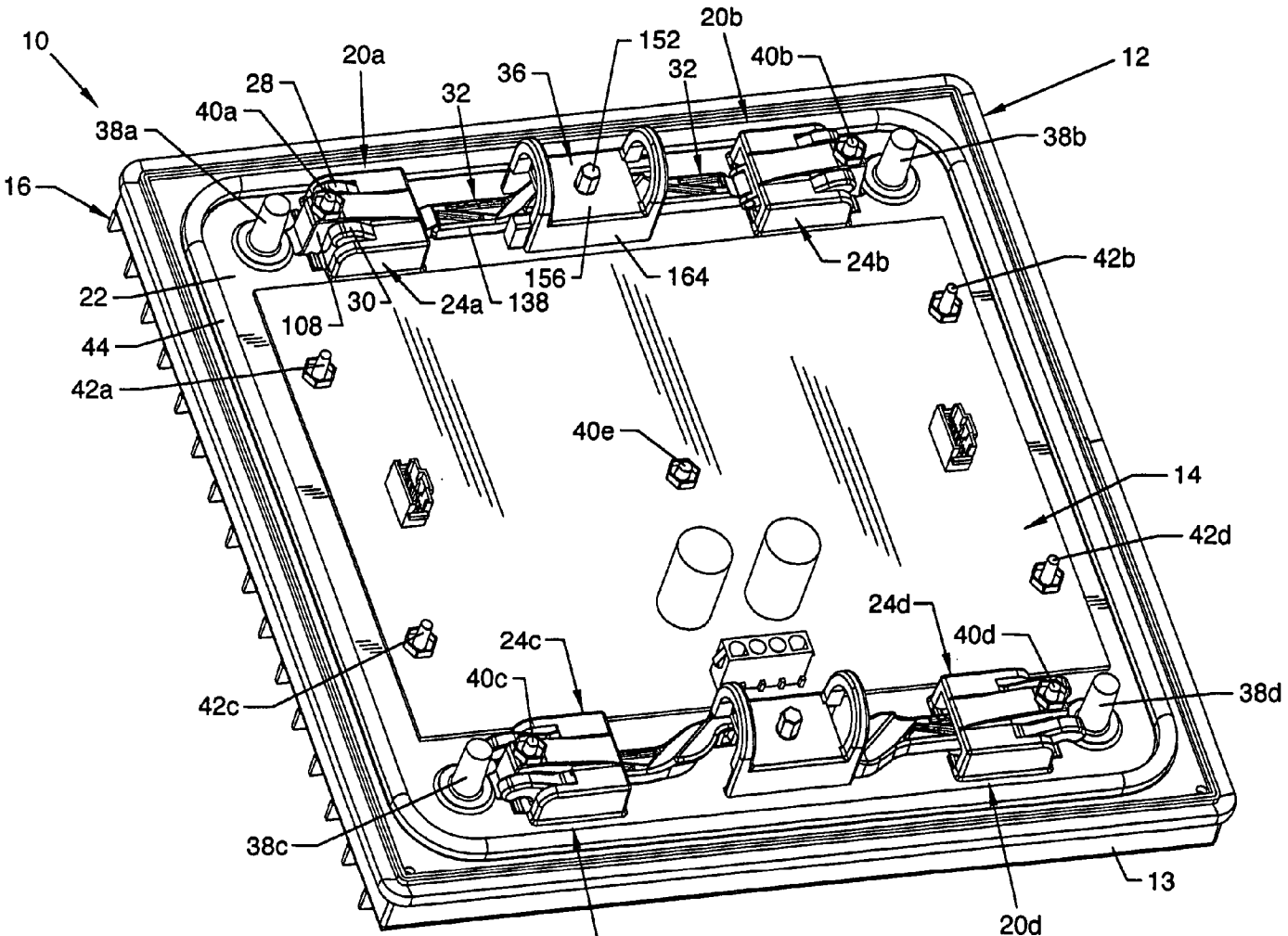
FIG. 1 is a rear view of an electronic display module having a four-point latching system which is for incorporation into an electronic sign.

FIG. 1 is a rear view of an electronic display module having a four-point latching system which is for incorporation into an electronic sign and which together with the process for incorporating it into an electronic sign constitutes the present invention. The electronic display module having a four-point latching system is designated in its entirety by the reference numeral 10 and includes a main housing 12, a driver board 14 secured to the back of the main housing 12, and a louver panel 16 and an LED display panel 18 (FIGS. 2 and 3) located at the front of the main housing 12. Also included are latch mechanisms 20*a*, 20*b*, 20*c* and 20*d* which are similar and of mirror image-like construction, which are comprised of parts in commonality, and which are located near the periphery of and substantially at the corners of a panel 22. The panel 22 extends across and comprises a portion of the main housing 12 and is bounded by a continuous configured peripheral wall 13. The latch mechanisms 20*a*, 20*b*, 20*c* and 20*d* include configured latch housings 24*a*–24*d*, respectively, and components which operate within and about the latch housings 24*a*–24*d* and which are part of or are associated with the latch housings 24*a*–24*d*. For brevity, only the structure of the latch mechanism 20*a* and closely associated components thereof are fully described. Some of the fully or partially visible components relating to and/or which are part of the latch mechanism 20*a* include the latch housing 24*a*, outboard and inboard latch arms 28 and 30 being part of a latch 26 (FIG. 4) extending through the latch housing 24*a*, and an actuator arm 32. One end of the actuator arm 32 connects to the latch 26, as later described in detail, and the other end communicates with an actuator gear 34 (FIG. 4) contained in a gear support housing 36 secured to the panel 22 midway between the latch housings 24*a* and 24*b*. Also shown in close proximity to the latch mechanisms 20*a*, 20*b*, 20*c* and 20*d* are a plurality of locator posts 38*a*–38*d* extending outwardly and rearwardly from the panel 22 for use in alignment of the main housing 12 with a mounting panel assembly 39 (FIGS. 2 and 3) to which the four-point latching system secures. Also shown are the upper portions of the louver panel attachment pins 40*a*–40*e* (and nuts) extending from the louver panel 16, through the LED display panel 18, and through and becoming visible at the upper regions of the latch mechanisms 20*a*, 20*b*, 20*c* and 20*d*, as well as the upper portions of the driver board attachment pins 42*a*–42*d* (and nuts) extending from the panel 22 through and becoming visible at the upper portion of the driver board 14. A flexible and pliable seal 44 is located at the periphery of the panel 22 for sealing against the mounting panel assembly 39.

Figure 2:
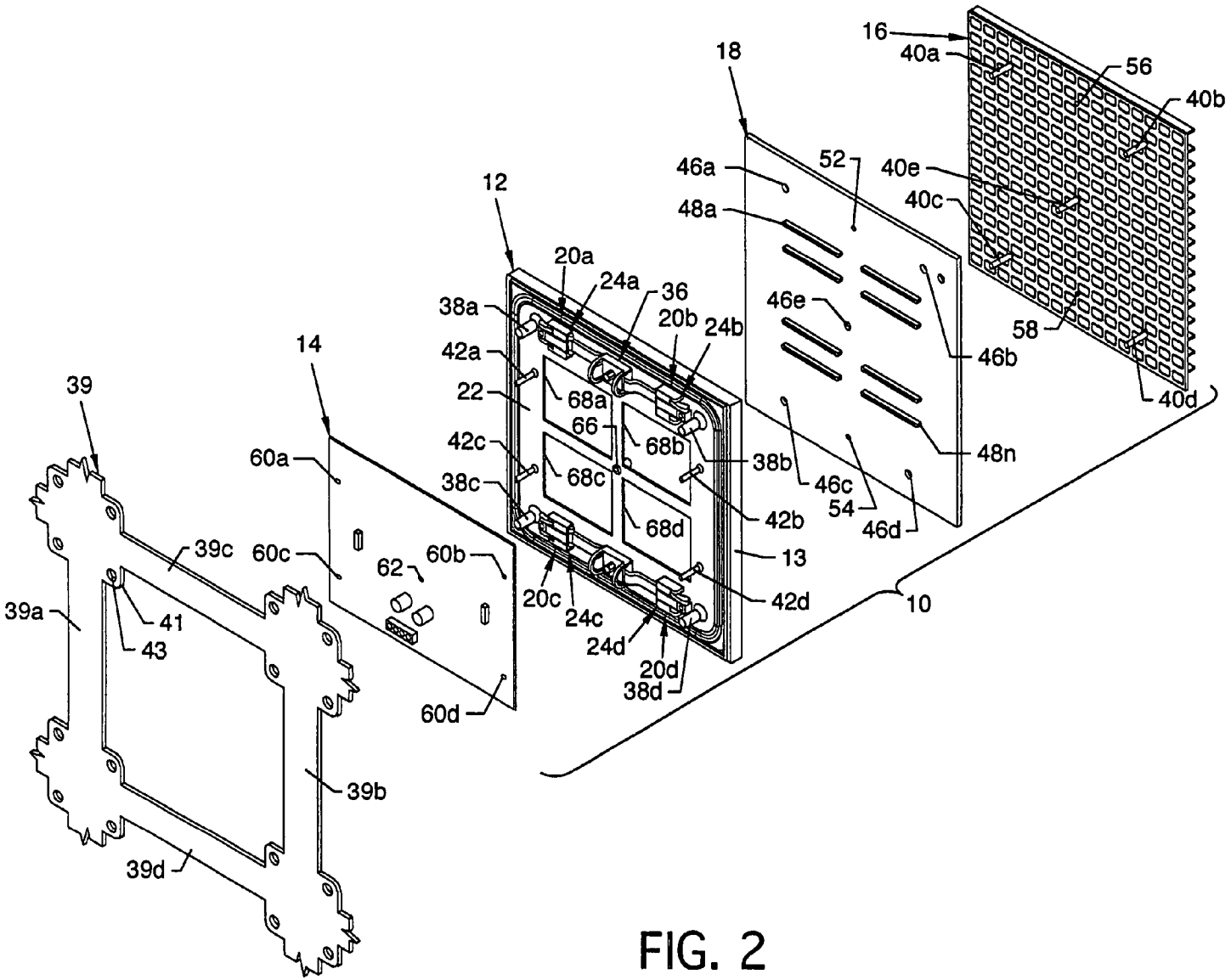
FIG. 2 is an exploded rear view showing the alignment of the major structural components of the electronic display having a four-point latching system to each other and to a mounting panel assembly.

FIG. 2 is an exploded rear view showing the alignment of the major structural components of the electronic display module having a four-point latching system 10 including the main housing 12, the LED display panel 18, the louver panel 16 and the driver board 14. The mounting panel assembly 39 to which the electronic display module having a four-point latching system 10 aligns and attaches is also shown. The mounting panel assembly 39 includes a series of vertical plates connected to a series of horizontal plates, of which only vertical plates 39*a* and 39*b* and horizontal plates 39*c* and 39*d* are shown. Tabs 41 are provided at the junctions of the vertical plates and the horizontal plates, and each tab is provided with an alignment hole 43. Additionally shown are pluralities of body holes in the LED display panel 18, the main housing 12, the driver board 14, and the mounting panel assembly 39. The LED display panel 18 includes a plurality of body holes 46*a*–46*e* placed as shown, the majority of which are near the periphery of the LED display panel 18 for accommodation of the plurality of louver panel attachment pins 40*a*–40*e* of the louver panel 16, as well as including a plurality of connectors 48*a*–48*n* which connect to corresponding connectors 50*a*–50*n* (FIG. 3) on the driver board 14. Access holes 52 and 54 in the LED display panel 18 for accessing the actuator gear 34 are also shown. Correspondingly, access holes 56 and 58 are also provided in the louver panel 16 for accessing the actuator gear(s) 34 through access holes 52 and 54 in the LED display panel 18. The driver board 14 includes a plurality of body holes 60*a*–60*d* for accommodation of the plurality of driver board attachment pins 42*a*–42*d* and a centrally located body hole 62 for the accommodation of the louver panel attachment pin 40*e*. Each latch housing 24*a*–24*d* includes a body hole 64 (FIG. 4) for accommodation of the louver panel attachment pins 40*a*–40*d*. A body hole 66 is also located central to the panel 22 for accommodation of the louver attachment pin 40*e*. The panel 22 also includes four cutouts 68*a*–68*d* for accommodation and connection of connectors 48*a*–48*n* and 50*a*–50*n* therethrough.

Figure 3:
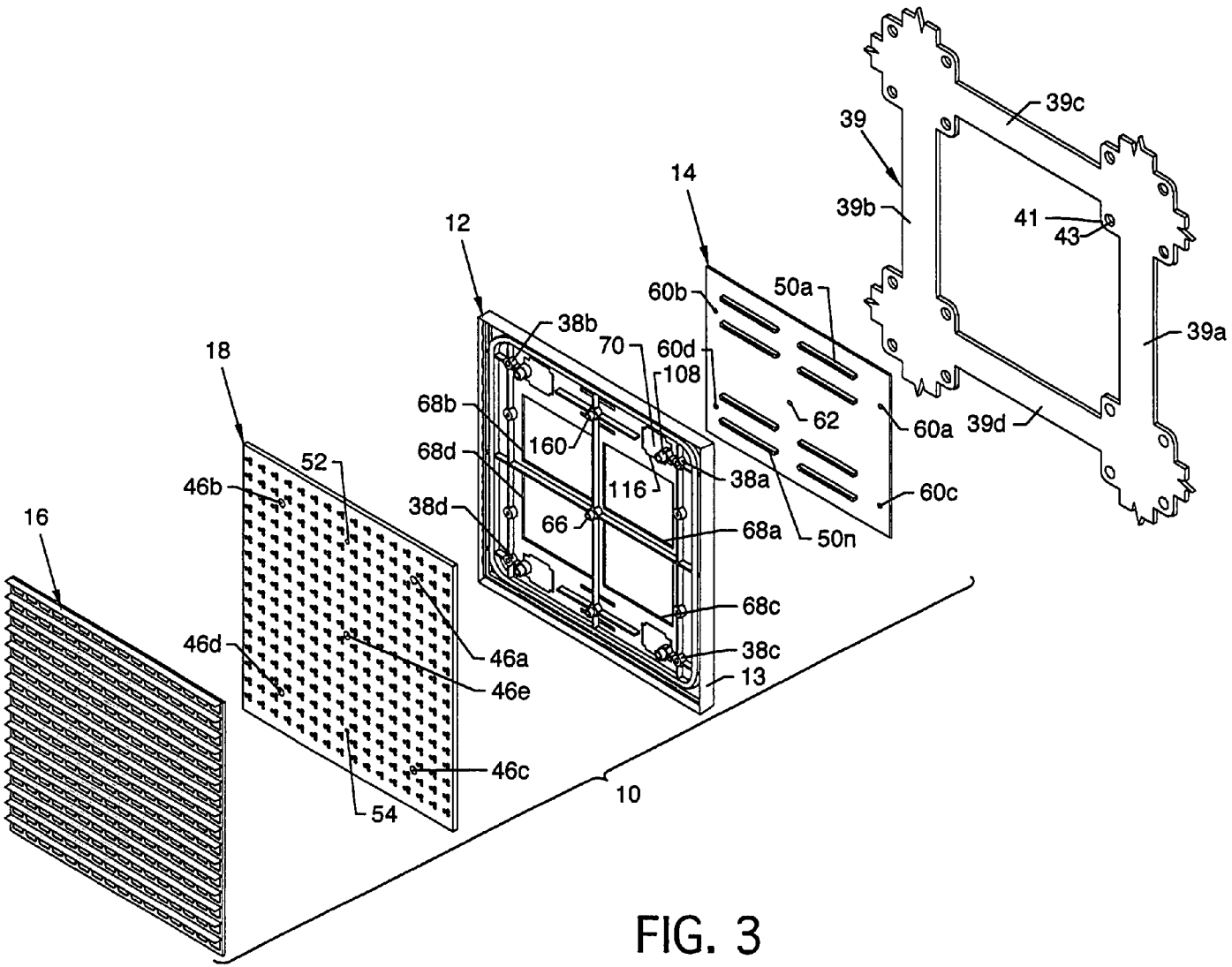
FIG. 3 is an exploded front view showing the alignment of the major structural components of the electronic display module having a four-point latching system to each other and to a mounting panel assembly.

FIG. 3 is an exploded front view showing the alignment of the major structural components of the electronic display module having a four-point latching system 10 including the main housing 12, the LED display panel 18, the louver panel 16 and the driver board 14. The mounting panel assembly 39 to which the electronic display module having a four-point latching system 10 aligns and attaches is also shown.

Figure 4:
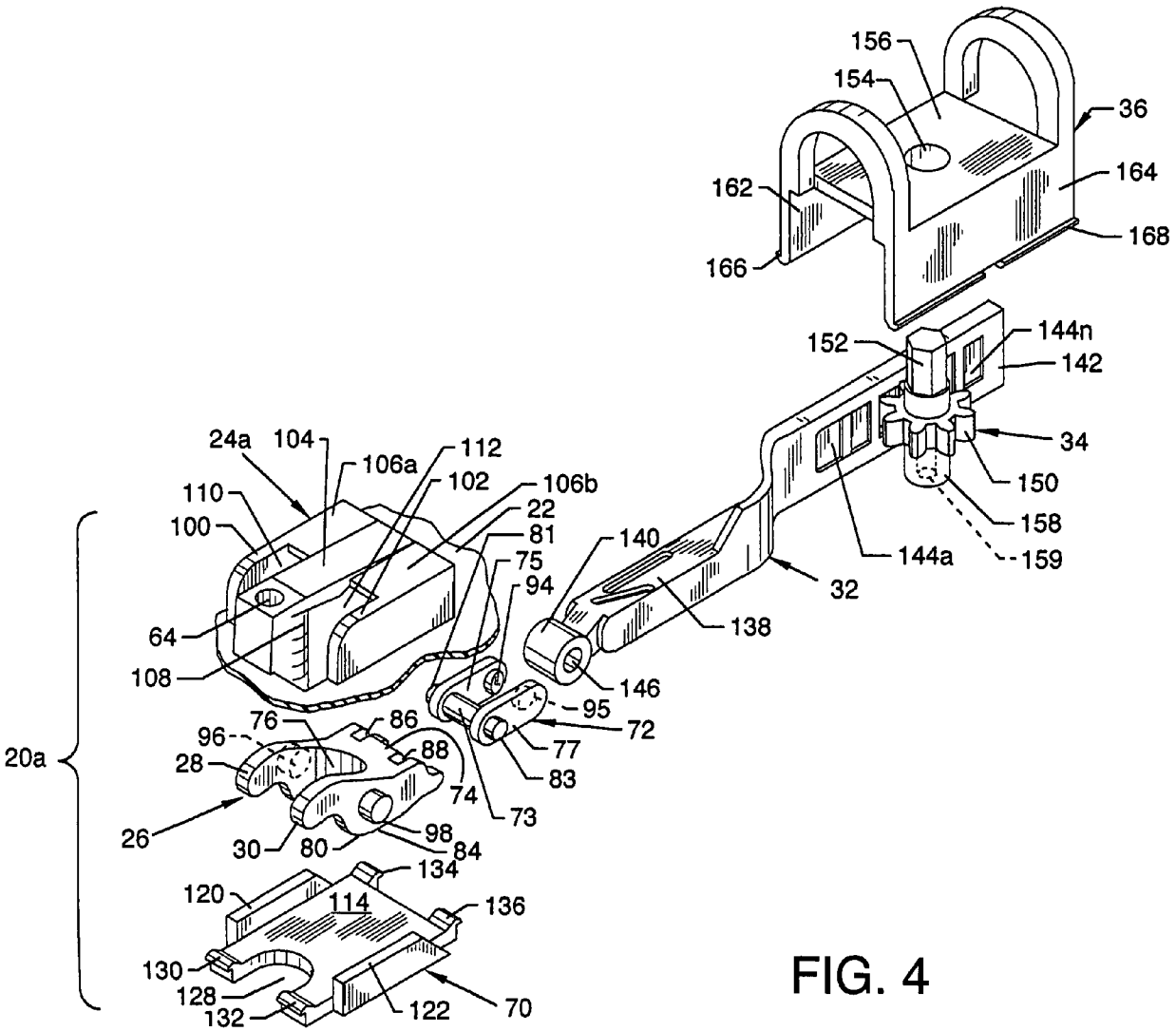
FIG. 4 is an isometric exploded view of the components comprising a latch mechanism and associated components including those components essential for the operation of one or more of the latch mechanisms.

FIG. 4 is an isometric exploded view of the components comprising the latch mechanism 20*a* and associated components including, but not limited to, those components essential for the operation of one or more of the latch mechanisms 20*a*–20*d*. The main components included are the latch 26, the latch housing 24*a*, a latch lock plate 70, the actuator arm 32, a linkage 72, the actuator gear 34, and the gear support housing 36.

Figure 5:
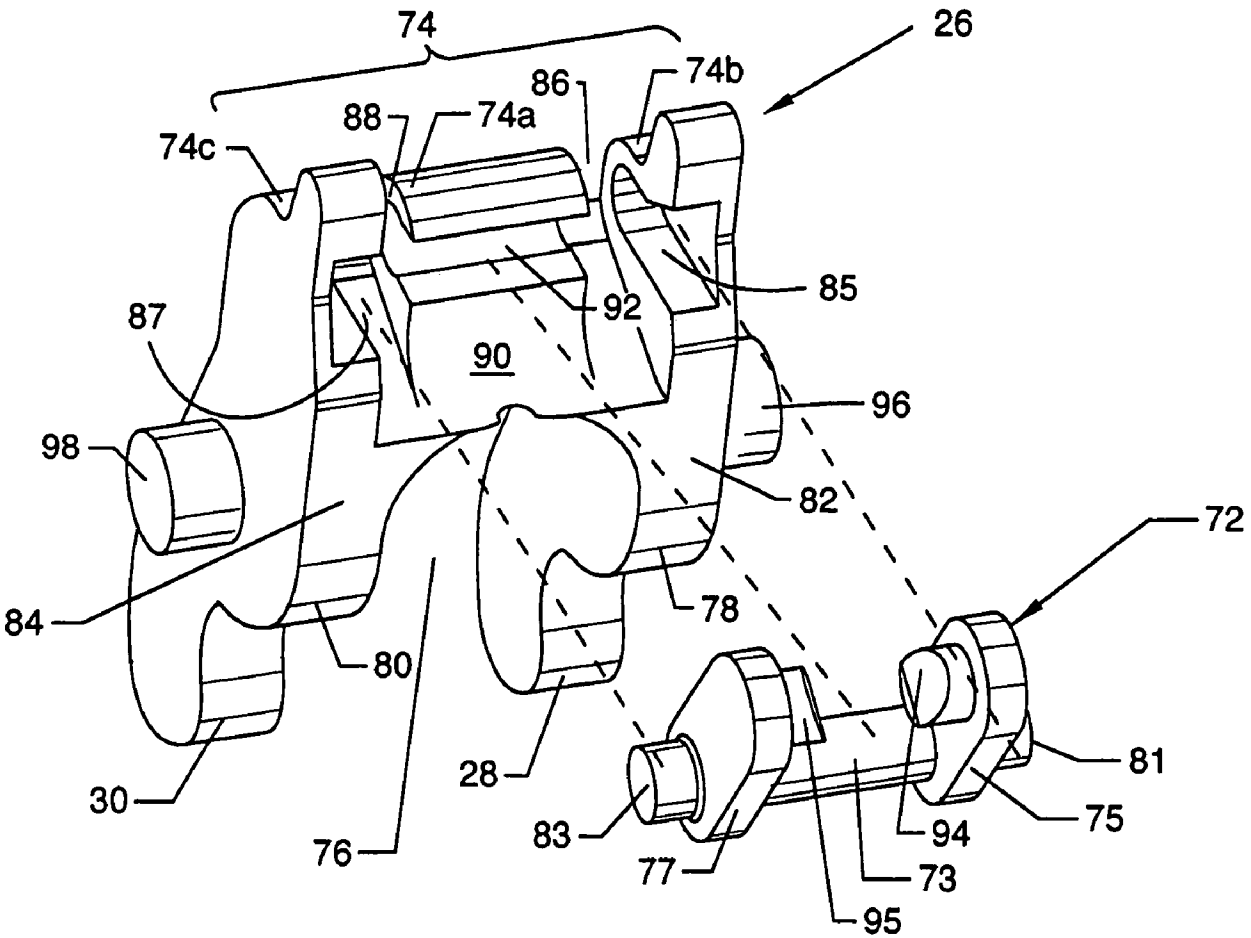
FIG. 5 is an inverted view of a latch and linkage showing the relationship of the latch to the linkage.

With reference to FIGS. 4 and 5, the latch 26 is now described. The latch 26 is made in one piece and includes upwardly curved and opposed outboard and inboard latch arms 28 and 30, respectively, connected in common at one end by an integral attachment fixture 74 and separated by an interlatch space 76. The outboard and inboard latch arms 28 and 30 also extend to include radiused curves 78 and 80 and to include planar bottom surfaces 82 and 84. The attachment fixture 74 is comprised of a central attachment fixture 74*a*, an outboard attachment fixture 74*b*, and an inboard attachment fixture 74*c*. The central attachment fixture 74*a* includes a slot 92 for snap engagement with a rounded crossmember pivot bar 73 connecting links 75 and 77 of the linkage 72. Slots 86 and 88 are located between the central attachment fixture 74*a* and the outboard and inboard attachment fixtures 74*b* and 74*c* for accommodation of members of the linkage 72. Slots 85 and 87 are included in the outboard and inboard attachment fixtures 74*b* and 74*c* facing the slots 86 and 88, respectively. Geometry adjacent the slots 86 and 88 opposing the attachment fixture 74 in the form of slots is provided for accommodation and snap engagement of externally located pivot pins 81 and 83 extending outwardly from the links 75 and 77, as shown in FIG. 5. A recess 90 (FIG. 5), which can be radiused, is located generally between the attachment fixture 74 and the planar bottom surfaces 82 and 84 to accommodate the geometry of the actuator arm 32, as described later in detail. Pivot pins 94 and 95 having beveled ends project inwardly from the links 75 and 77, respectively, to connect to the attachment fixture 140 of the actuator arm 32. Opposing outboard and inboard posts 96 and 98, respectively, extend outwardly from the central regions of the outboard latch arm 28 and inboard latch 30, respectively, to align in opposed slots in the interior of the latch housing 24*a*, as described later in detail. The orientation of the attachment fixture 74, and thus the orientation of the latch 26, is influenced by a guide body 104, as later described in detail.

Figure 6:
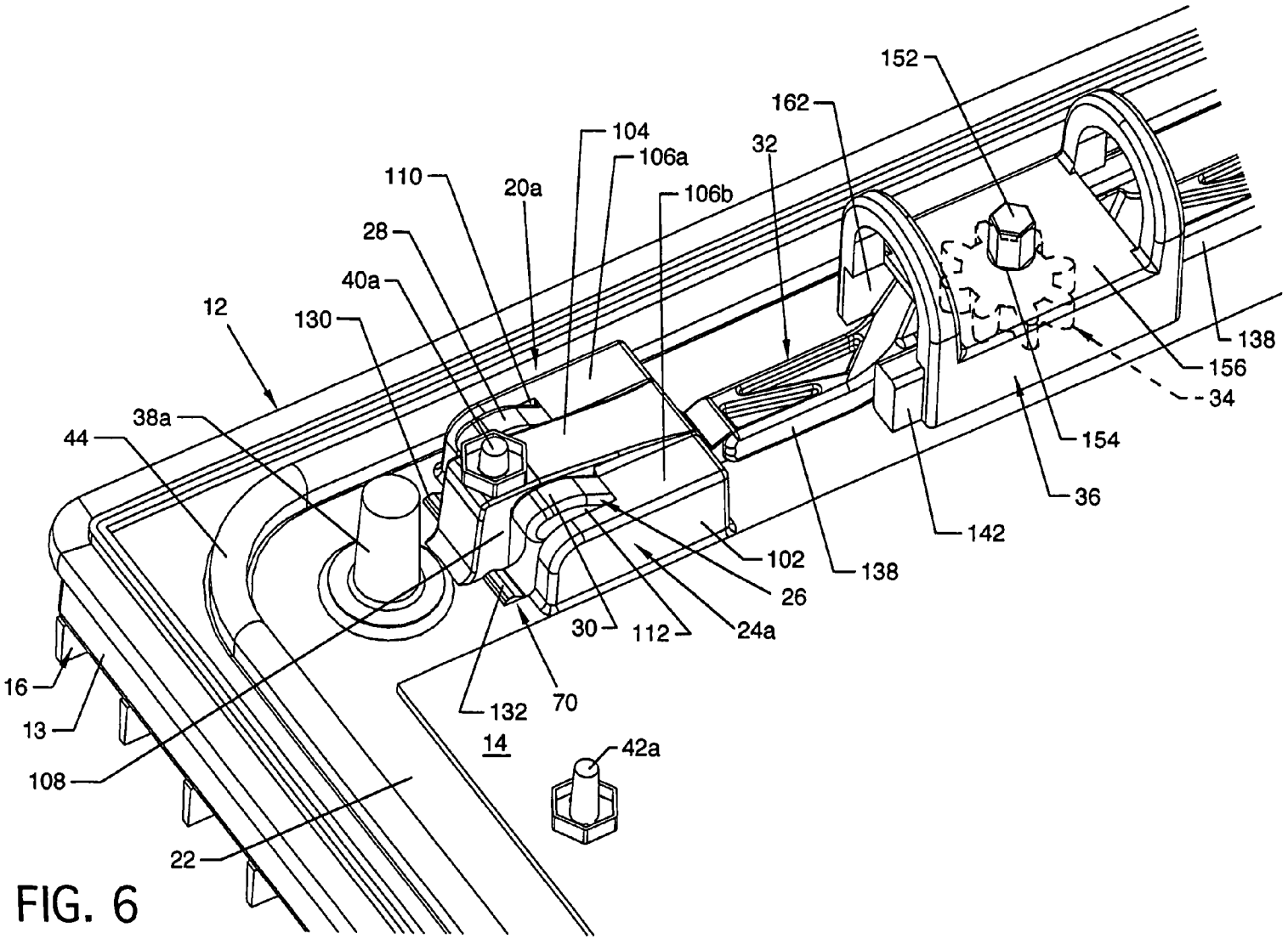
FIG. 6 is a view of the latch mechanism being connected by an actuator arm to an actuator gear.

The latch housing 24*a* is now described with reference to FIGS. 4, 7 and 8. The latch housing 24*a*, which is substantially a one-piece structure and which is integral to and extends from the partially shown panel 22 (FIG. 4), includes an outboard sidewall 100; an inboard sidewall 102; top walls 106*a* and 106*b*; an opening 113 bounded by the outboard sidewall 100, the inboard sidewall 102, and the two top walls 106*a* and 106*b*; and a guide body 104 located centrally between the top walls 106*a* and 106*b* and being of one continuous integral piece with the top walls 106*a* and 106*b* as well as being of one continuous integral piece with a louver pin receptor post 108 extending from the panel 22. The top walls 106*a* and 106*b* extend in a profile partially common with and between part of the centrally located guide body 104 and portions of the outboard sidewall 100 and the inboard sidewall 102. Outboard and inboard slots 110 and 112, respectively, are located between the ends of the outboard sidewall 100 and inboard sidewall 102 and the centrally located guide body 104 and the louver pin receptor post 108 for accommodation of the outboard latch arm 28 and the inboard latch arm 30 of the latch 26, as shown in FIG. 6. The opening 113 (FIG. 7) facing the opposing latch housing 24*b* is included between the outboard sidewall 100, the inboard sidewall 102, and the top walls 106*a* and 106*b* and the guide body 104 to accommodate one end of the latch 26, the linkage 72, and one end of the actuator arm 32, as shown later in detail.

Figure 9:
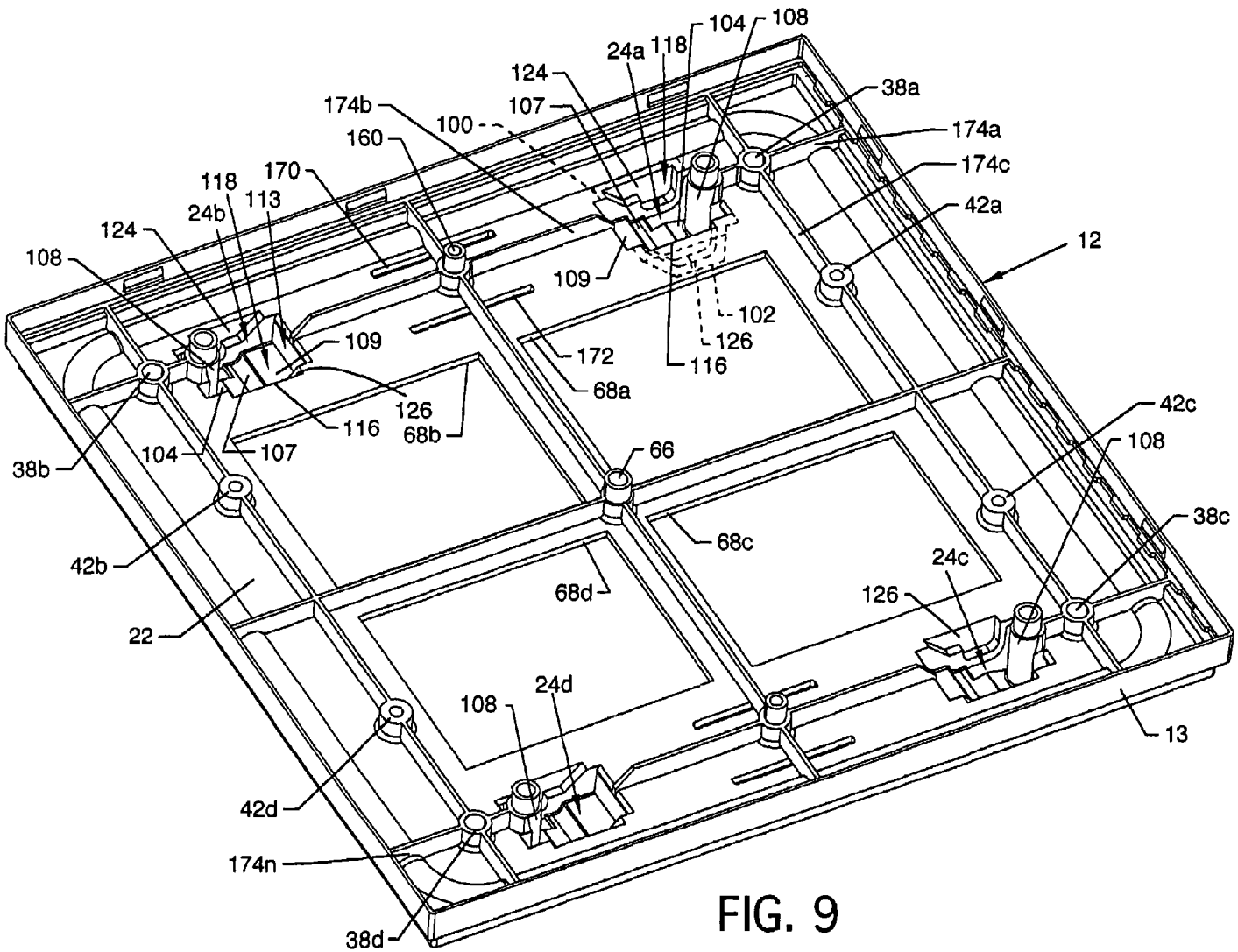
FIG. 9 is a front view of the main housing where the latch lock plates and latches are not shown in order to reveal other structures residing on the panel including the geometry of the interior cavities formed in part by the structure the latch housings.
Figure 10:
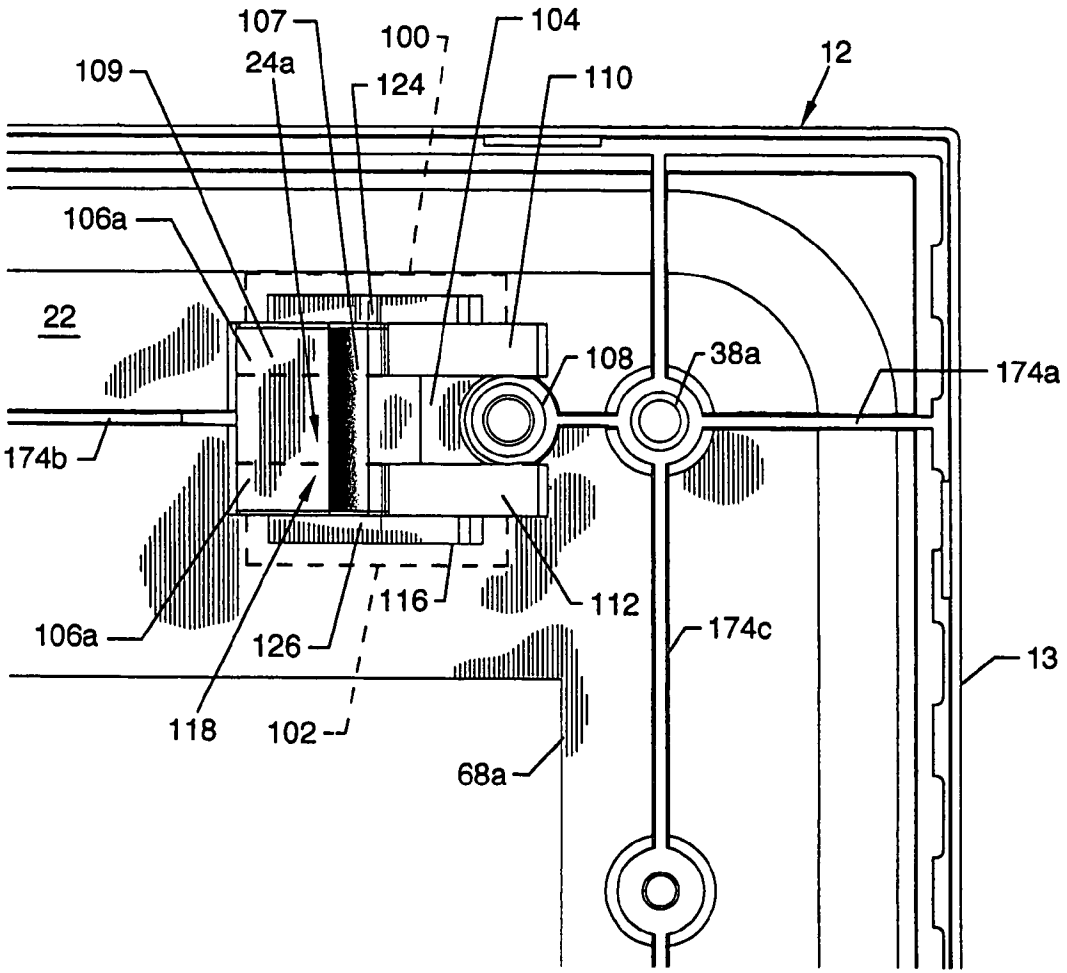
FIG. 10 is a front view of a portion of the latch housing of the main housing showing the relationship of the outboard and inboard slots to the outboard and inboard sidewalls, the top walls, the guide body and the louver pin receptor post.
Figure 12:
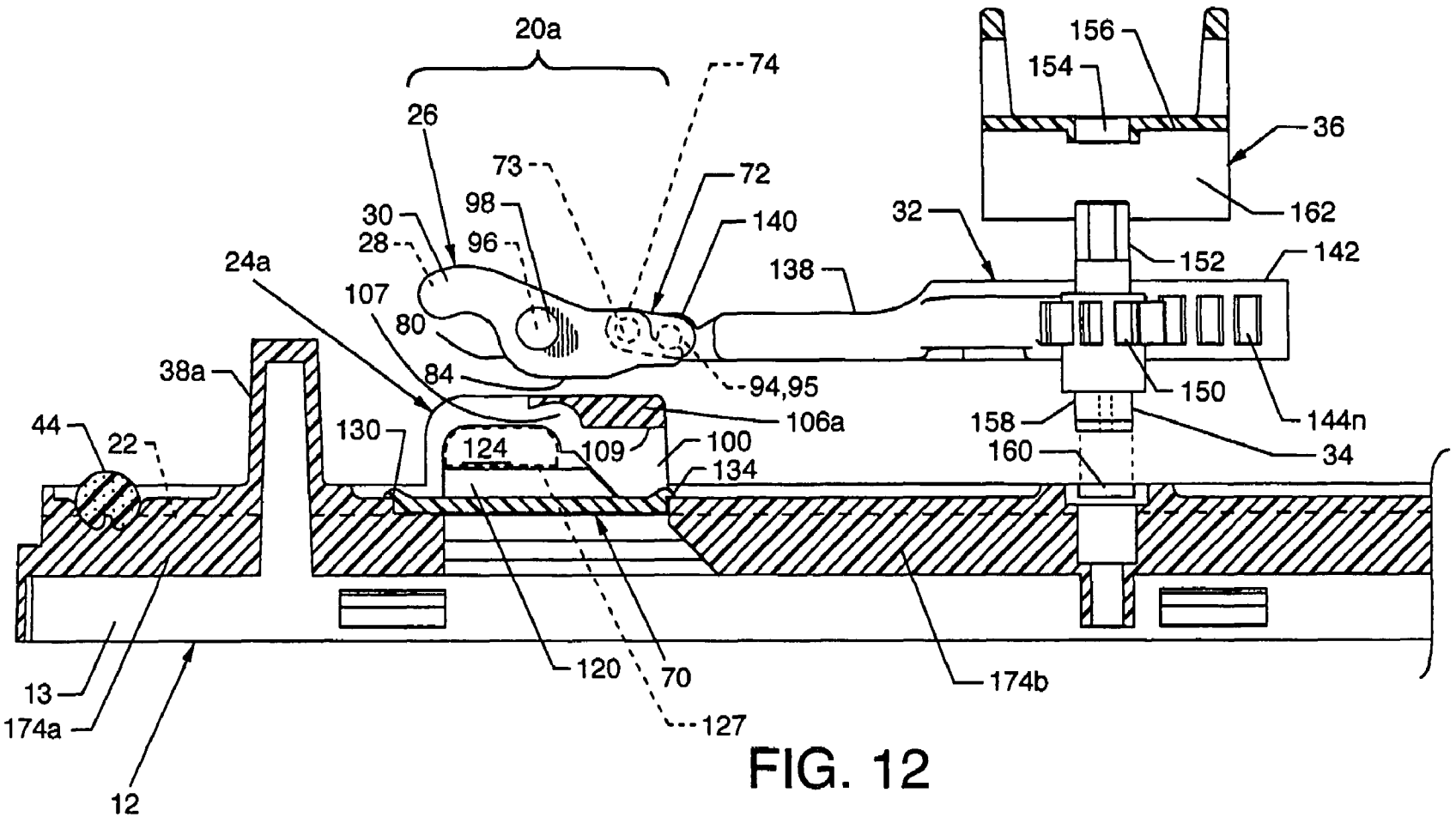
FIG. 12 is a view like FIG. 11 but showing the components partially assembled.

The latch lock plate 70 frictionally engages and secures to a cutout 116 (FIG. 9) which is formed in part by the junction of the panel 22 and one edge each of the outboard and inboard sidewalls 100 and 102 and other edges adjacent thereto which form a cavity 118 in conjunction with the latch housing 24*a*. Outboard and inboard retainer bars 120 and 122, respectively, extend from the edges of a main panel 114 of the latch lock plate 70 to assist in forming an outboard slot 127 (denoted by dashed lines in FIGS. 8 and 12) and a corresponding and opposed inboard slot 129 (FIG. 8) in conjunction with the outboard and inboard configured cavities 124 and 126 (FIGS. 9 and 10). As shown in FIG. 12 and in respect to the outboard slot 127, the outboard retainer bar 120 occupies only a portion of the outboard configured cavity 124 leaving the unoccupied portion vacant to form the slot 127. The outboard slot 127 slidingly accommodates the outboard post 96 of the latch 26. Accordingly, the inboard retainer bar 122 occupies a portion of the inboard configured cavity 126 to form the inboard slot 129 opposing the outboard slot 127 to slidingly accommodate the inboard post 98 of the latch 26. One end of the main panel 114 includes a cutout 128 flanked by retainer catches 130 and 132, and the opposing end of the main panel 114 includes retainer catches 134 and 136. The retain r catches 130, 132, 134 and 136 secure within the cutout 116 to secure the latch lock plate 70 to the panel 22. The cutout 128 accommodates the louver pin receptor post 108.

The actuating arm 32 includes an actuator arm main body 138 having an attachment fixture 140, which can be tubular, and an actuator arm gear receptor 142 oriented 90 degrees about the centerline of the actuator arm main body 138. A plurality of gear receptor cavities 144*a*–144*n* are located along the actuator arm gear receptor 142 for engagement with the actuator gear 34. A pivot hole 146 in the attachment fixture 140 slidingly engages and accommodates pivot pins 94 and 95 of the linkage 72 to attach the attachment fixture 140 of the actuator arm 32 to one end of the linkage 72, the rounded crossmember pivot bar 73 of the linkage 72 snappingly engages the slot 92 of the latch attachment fixture 74, and the slots 85 and 87 of the latch 26 snappingly engage and are accommodated by the pivot pins 81 and 83 of the linkage 72, thereby flexibly linking the actuator arm 32 to the latch 26. It is to be noted that one end of the linkage 72 is accommodated by the slots 86 and 88 adjacent to the central attachment fixture 74*a*.

The actuator gear 34 includes opposing shafts extending centrally from a gear 150. One shaft 152 includes surfaces, such as hexagonally arranged surfaces, suitable for manual operation or operation by a suitable tool. The shaft 152 is accommodated by a support hole 154 shown extending through a central panel 156 of the gear support housing 36. The opposing shaft 158 is accommodated by a support hole 160 (FIG. 7) located on the panel 22 between the opposing latch housings 24*a* and 24*b*. The shaft 158 includes a suitably shaped receptacle hole 159 for an Allen wrench or other tool for actuation of the actuator gear 34 by a suitably shaped tool from the front of the four-point latching system 10.

The gear support housing 36 includes opposing panels 162 and 164 extending from the central panel 156 that include retainer catches 166 and 168, respectively, which are segmented and extend outwardly therefrom for snap engagement with opposing outboard and inboard slots 170 and 172, respectively, located in the panel 22 of the main housing 12 to secure the gear support housing 36 to the panel 22 of the main housing 12.

Figure 17:
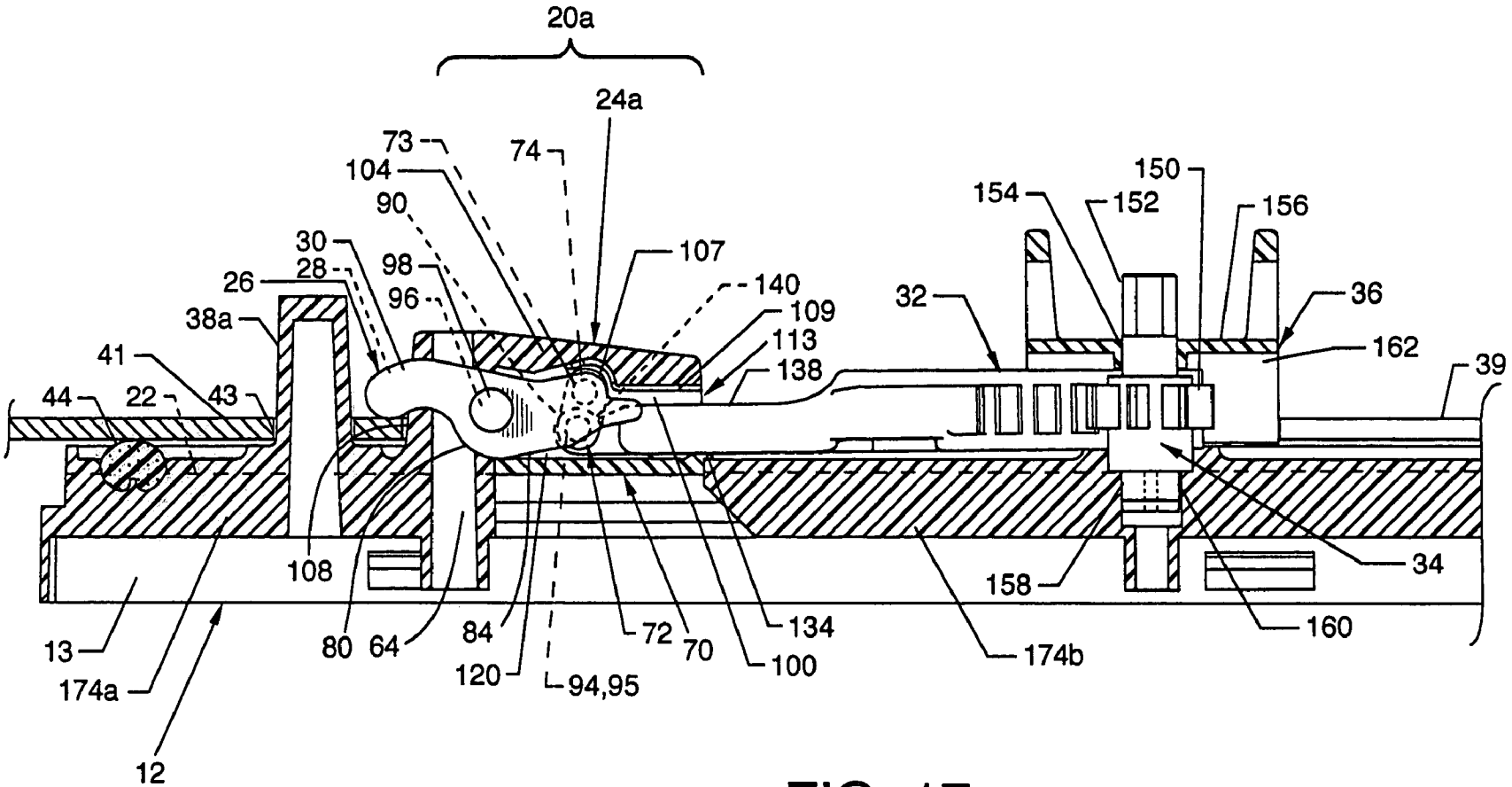

FIG. 5 is an inverted view of the latch 26 and linkage 72 showing the relationship of the latch 26 to the linkage 72. Shown in particular are the slots 85, 87 and 92 which snappingly and rotatingly engage pivot pins 81 and 83 and the rounded crossmember pivot bar 73, respectively. The recess 90, part of which is radiused, accommodates the attachment fixture 140 of the actuator arm 32 and the slots 88 and 86 also accommodate a portion of the links 77 and 75 of the linkage 72, as shown in FIG. 17, during final rotational actuation of the latch 26. Also shown are the outboard and inboard latch arms 28 and 30 and the planar bottom surfaces 82 and 84 of the latch 26.

FIG. 6 is a view of the latch mechanism 20*a* being connected by the actuator arm 32 to the actuator gear 34. Especially shown is the relationship of the outboard latch arm 28 and the inboard latch arm 30 to the outboard slot 110 and the inboard slot 112, respectively, where the outboard latch arm 28 and the inboard latch arm 30 can be positioned horizontally within the outboard slot 110 and the inboard slot 112 as well as positioned toward the panel 22 in stages by action of the actuator gear 34 and the interceding actuator arm 32 with which the latch 26 can be positionally urged, as described herein.

Figure 7:
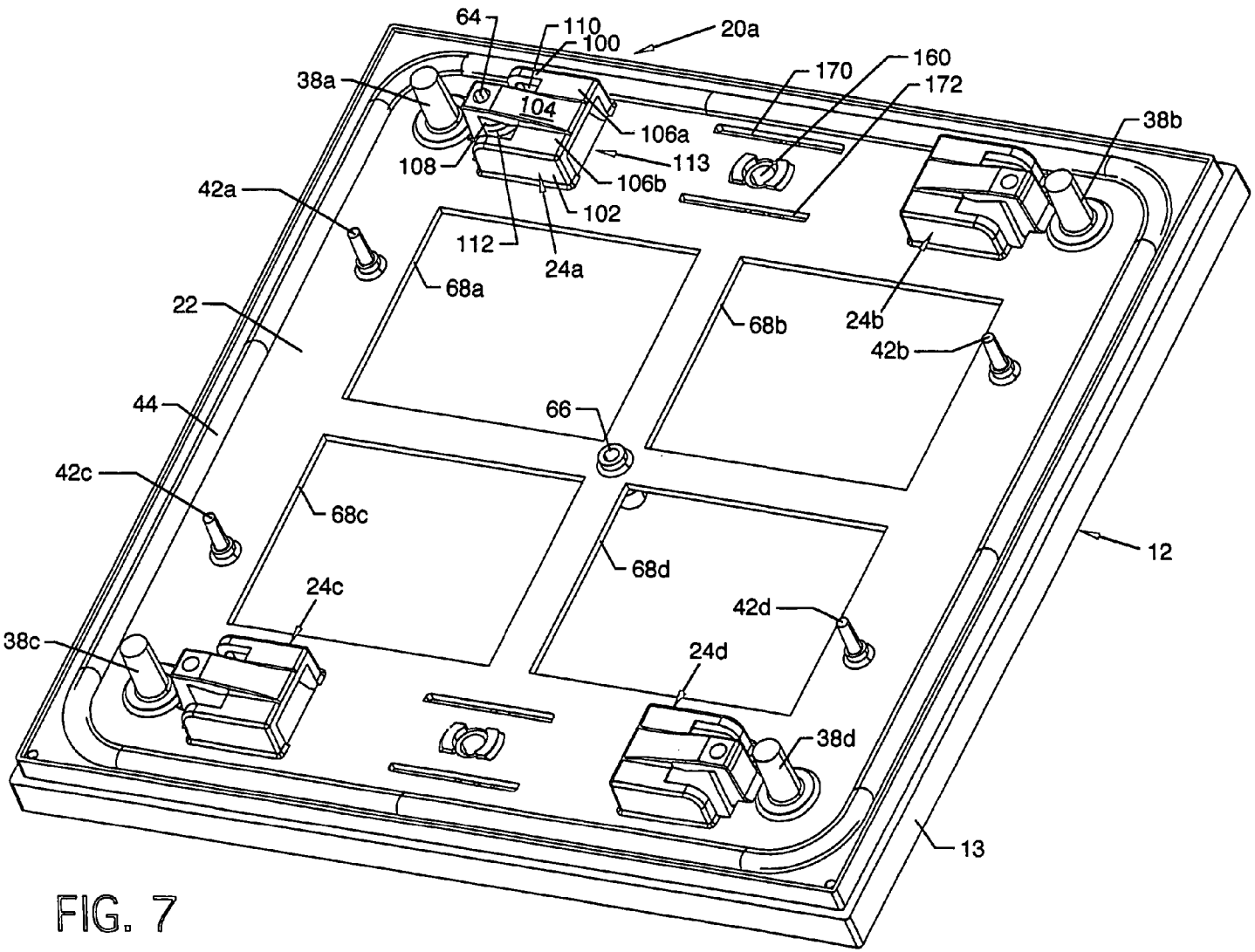
FIG. 7 is a rear view of the main housing where the gear support housings, the actuator gears, the actuator arms and the latches are not shown in order to reveal other structures residing on the panel.

FIG. 7 is a rear view of the main housing 12 where the gear support housings 36, the actuator gears 34, the actuator arms 32 and the latches 26 are not shown in order to reveal other structures residing on the panel 22. Shown in particular is the opening 113 of the latch housing 24*a* facing the opposing latch housing 24*b* and included between ends of the outboard sidewall 100 and inboard sidewall 102, ends of the top walls 106*a* and 106*b* and an end of the guide body 104 of the latch housing 24*a* to accommodate the placement of and the motion of one end of the latch 26 and one end of the connected actuator arm 32. Also shown on panel 22 is the support hole 160 which supports the shaft 158 of the actuator gear 34 and the outboard slot 170 and inboard slot 172 to which the outboard and inboard retainer catches 166 and 168 snappingly engage and secure.

Figure 8:
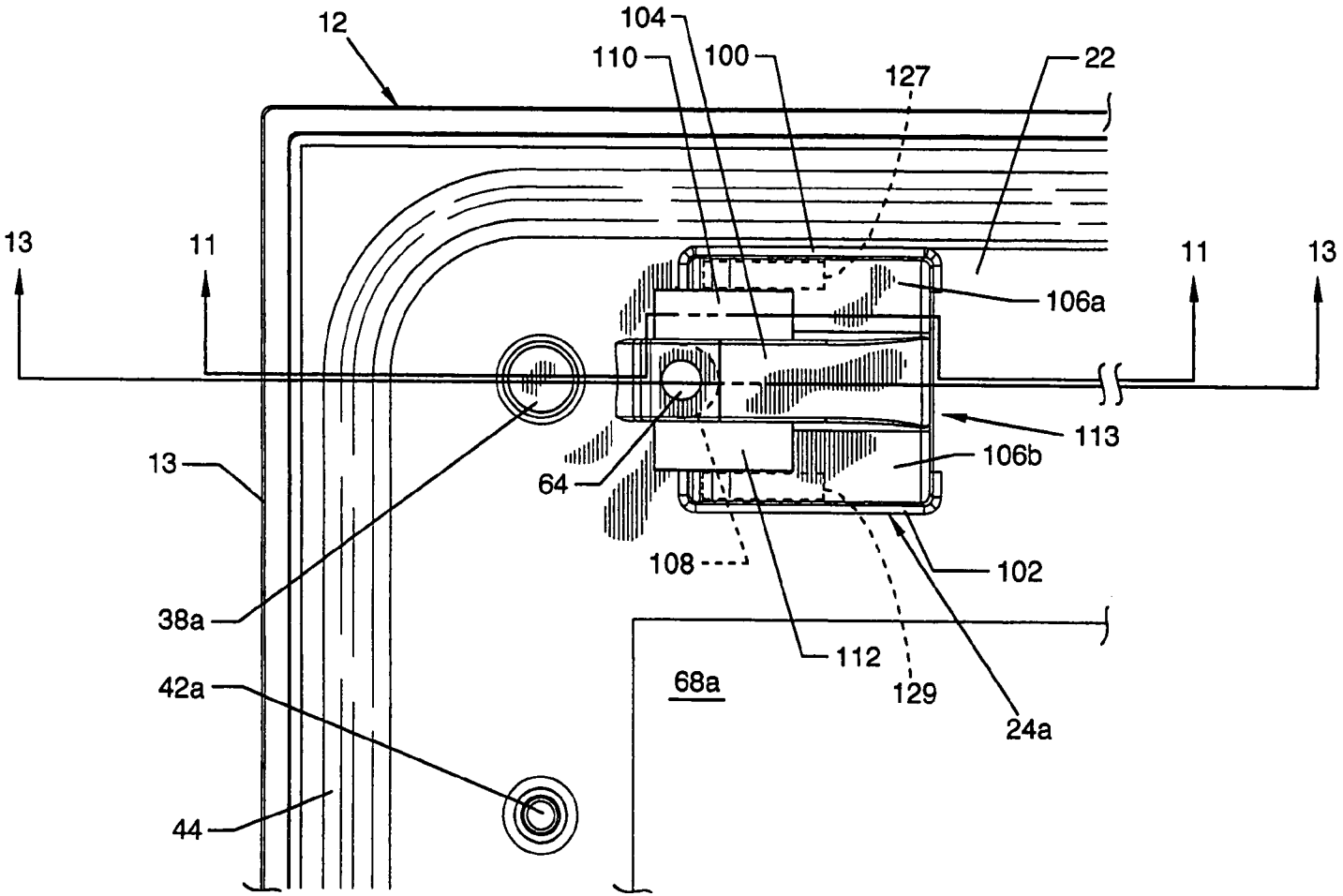
FIG. 8 is a rear view of a portion of a latch housing of the main housing showing the relationship of the outboard and inboard slots to the outboard and inboard sidewalls, the top walls and the guide body.

FIG. 8 is a rear view of a portion of the latch housing 24*a* of the main housing 12 showing the relationship of the outboard slot 110 to the outboard sidewall 100, the top walls 106*a* and 106*b*, the guide body 104 and the louver pin receptor post 108, as well as the relationship of the inboard slot 112 to the inboard sidewall 102, the top walls 106*a* and 106*b*, the guide body 104 and the louver pin receptor post 108. The outboard and inboard slots 127 and 129 which slidingly engage the outboard post 96 and the inboard post 98 of the latch 26 are also shown in dashed lines.

FIG. 9 is a front view of the main housing 12 where the latch lock plates 70 and latches 26 are not shown in order to reveal other structures residing on the panel 22 including the geometry of the interior cavities 118 formed in part by the structure of the latch housings 24*a*–24*n*. Shown in particular are the outboard configured cavity 124 and the inboard configured cavity 126 (dashed lines) located in the outboard sidewall 100 and the inboard sidewall 102 of the latch housing 24*a*. Also shown are a plurality of support struts 174*a*–174*n*, the length of some of which are interrupted, connected to and extending along the panel 22 and between the members of the peripheral wall 13 of the main housing 12. Also shown is the relationship of the louver pin receptor post 108, being supported in part by the support strut 174*a* and in part by a portion of the panel 22, to the guide body 104 to which one end the louver pin receptor post 108 is attached. A partially shown transversely oriented recess 107 which is curved and elongated is located on the guide body 104 and influences the orientation of the latch 26. A planar surface 109 which influences the behavior and orientation of the latch 26 is also partially shown.

FIG. 10 is a front view of a portion of the latch housing 24*a* of the main housing 12 showing the relationship of the outboard slot 110 to the outboard sidewall 100, the top walls 106*a* and 106*b*, the guide body 104 and the louver pin receptor post 108, as well as the relationship of the inboard slot 112 to the inboard sidewall 102, the top walls 106*a* and 106*b*, the guide body 104 and the louver pin receptor post 108.

Also shown is a forward facing planar surface 109 being in common with the forward facing surfaces of the top walls 106*a* and 106*b* and one forward facing surface of the guide body 104. The planar surface 109 is adjacent to and abutting the recess 107 which is transversely oriented, curved and elongated and forward facing. The recess 107 is partially common to the top walls 106*a* and 106*b* and partially common to the guide body 104, extending transversely as a unitary recess 107. The recess 107 and the planar surface 109 serve sequentially as a guide to influence the orientation of the latch 26 where the orientation of the latch 26 can be restricted or unrestricted.

Figure 11:
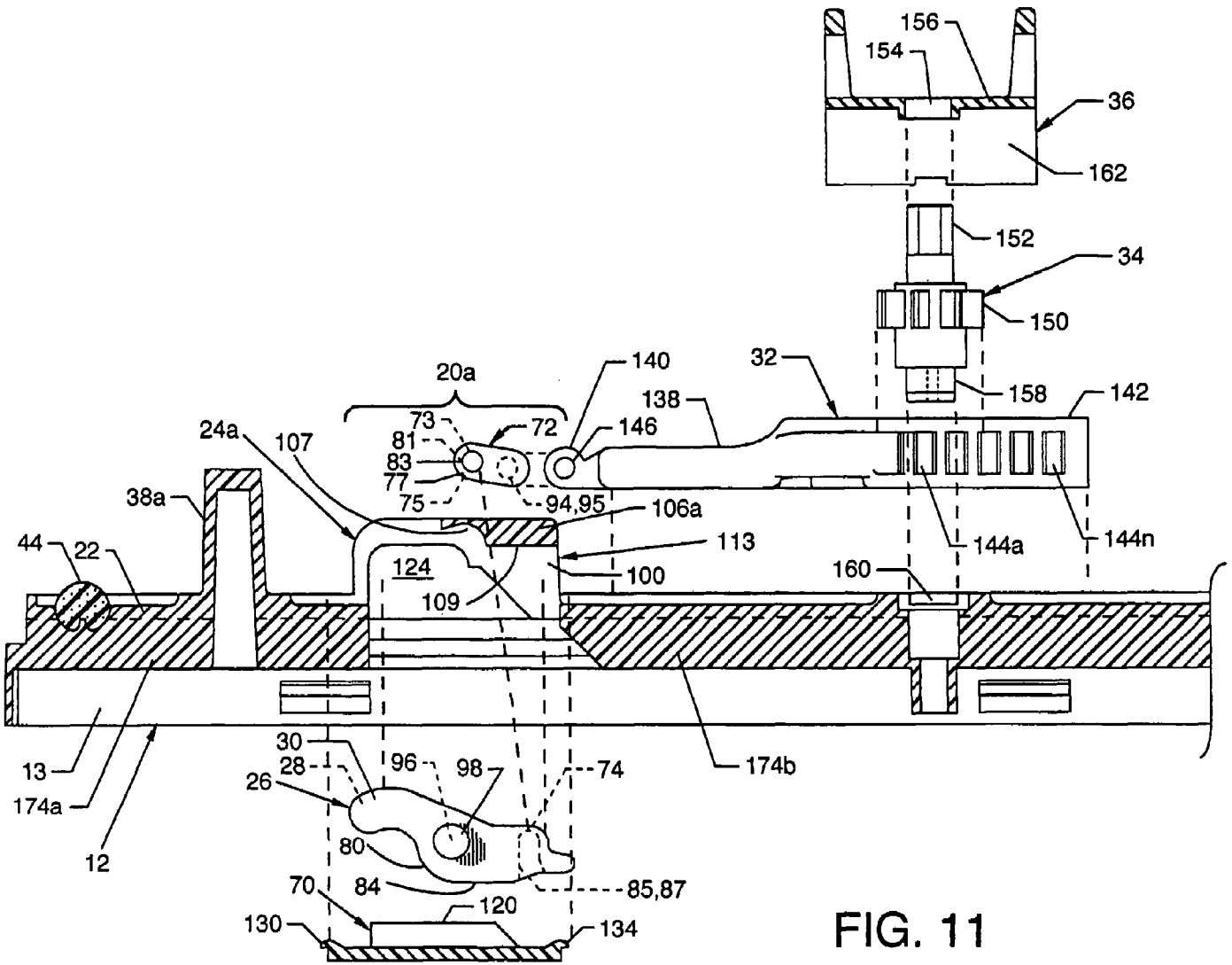
FIG. 11 is a view of the main housing showing a portion thereof in cross section along line 11—11 of FIG. 8 and showing in exploded relationship components thereof prior to assembly.
Figure 13:
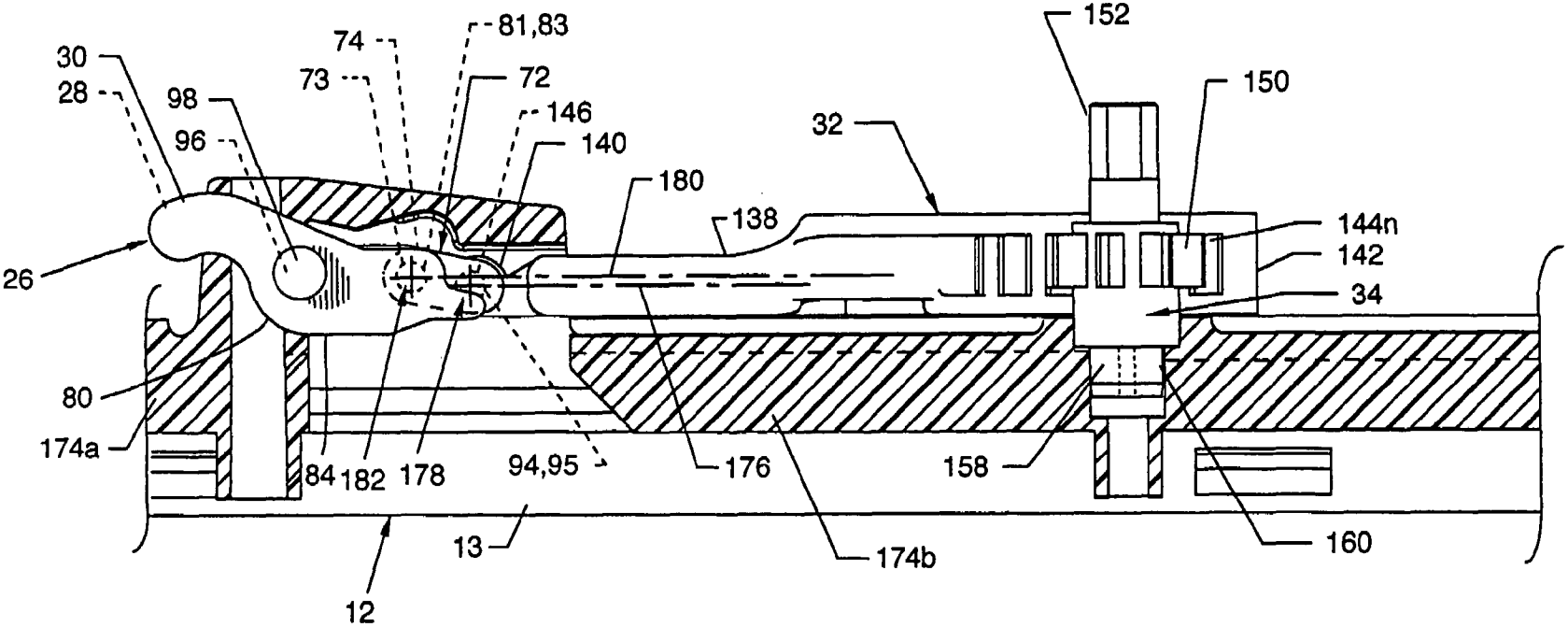
FIG. 13 is a view of the main housing showing a portion thereof in cross section along line 13—13 of FIG. 8 with the components fully assembled and illustrating the longitudinal travel path of a first axis of pivotal rotation and the longitudinal travel path of a second axis of pivotal rotation which is rearward of and off center with respect to the longitudinal travel path of the first axis of pivotal rotation.
Figure 18:
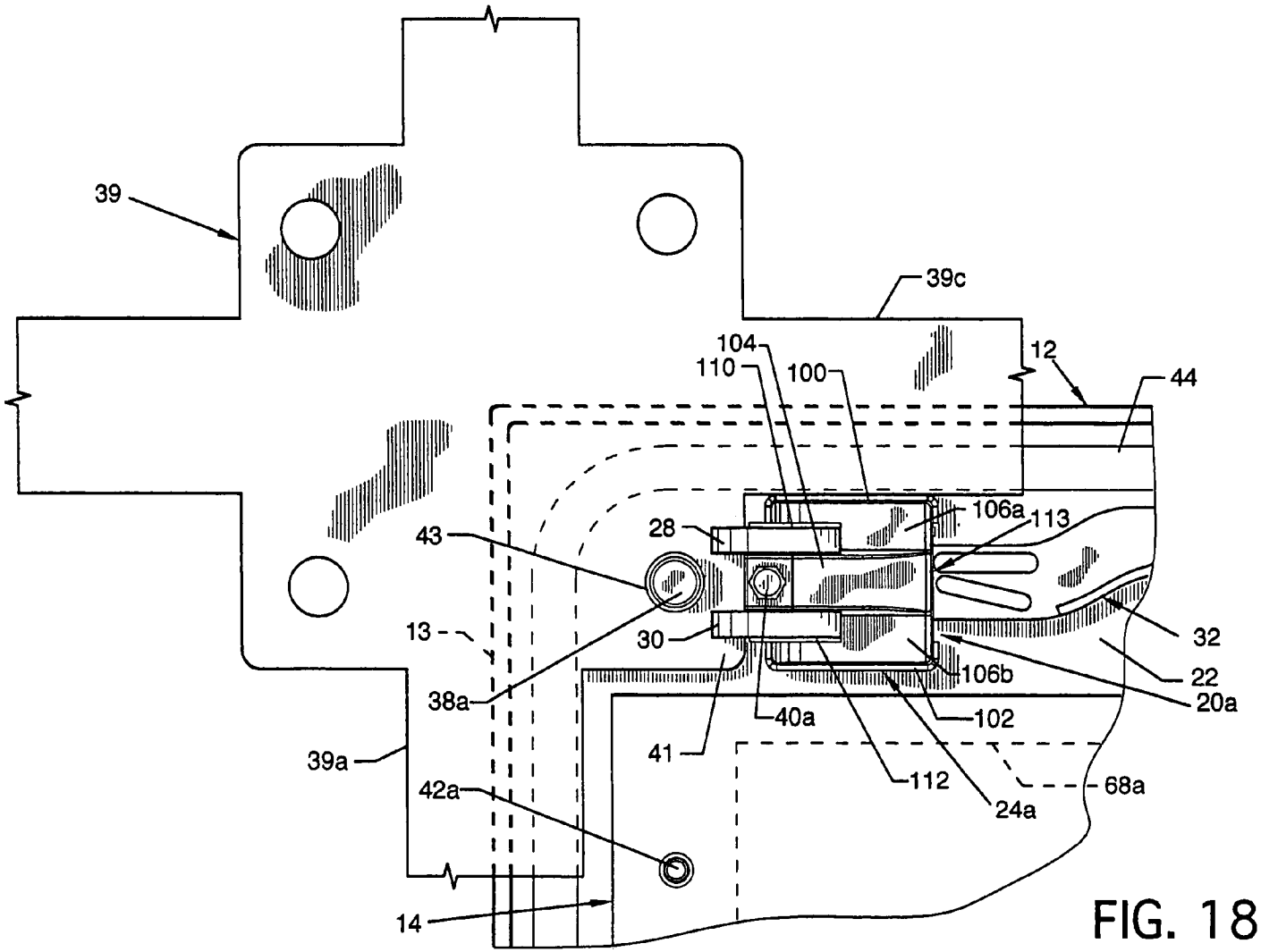

FIG. 11 is a view of the main housing 12 showing a portion thereof in cross section along line 11—11 of FIG. 8 and showing in exploded relationship components thereof prior to assembly. During assembly, the actuator arm 32 and the linkage 72 are maneuvered through the opening 113 to connect to the latch 26. The beveled end pivot pins 94 and 95 of the linkage 72 spreadingly impinge the attachment fixture 140 to temporarily spread the links 75 and 77 to accommodate snapping engagement of the pivot pins 94 and 95 with the ends of the pivot hole 146 of the attachment fixture 140 to pivotally secure one end of the linkage 72 to the actuator arm 32. The rounded crossmember pivot bar 73 at the opposing end of the linkage 72 snappingly engages the slot 92 (FIG. 5) of the attachment fixture 74 and can be pivoted therein, and the pivot pins 81 and 83 extending outwardly from the links 75 and 77, respectively, snappingly engage the innermost portions of the slots 85 and 77 of the latch 26 and can be pivoted therein. Such simultaneous pivoted engagements provide for pivotal attachment of the actuator arm 32 to the latch 26 by the use of the intermediate linkage 72 and for the utilization of one or more pivotal axes about which the linkage 72 can be pivoted to influence the orientation of the latch 26 with respect to the actuator arm 32. FIGS. 12–17 illustrate the attachment of the actuator arm 32 to the latch 26 by the interceding linkage 72 and the relationship thereof where an angular relationship of the linkage 72 to the actuator arm 32 is at first maintained to be followed by angular repositioning and displacement. As shown in FIG. 13, the longitudinal travel path 176 of a first axis of pivotal rotation 178 centering about the co-located pivot hole 146 of the attachment fixture 140 and the pivot pins 94 and 95 of the linkage 72 is linear, constant, and straight; whereas the longitudinal travel path 180 of a second axis of pivotal rotation 182 which is rearward of and off center with respect to the longitudinal travel path 176 of the first axis of pivotal rotation 178 and which centers about the co-located rounded crossmember pivot bar 73, pivot pins 81 and 83, and the connected attachment fixture 74 is initially linear, constant, and straight but subsequently is urged and caused to be a greater distance rearward of the longitudinal travel path 176 of the first axis of pivotal rotation 178. Such repositioning of the second axis of pivotal rotation 182 more rearwardly causes rotation of the latch 26 about the outboard and inboard posts 96 and 98 of the latch 26 to forcefully reposition the outboard and inboard latch arms 28 and 30 towards the panel 22 and against an interceding tab 41 of the mounting panel assembly 39, as shown in FIGS. 17 and 18. Overcenter locking is also provided as described later in detail.

Process

Figure 14:
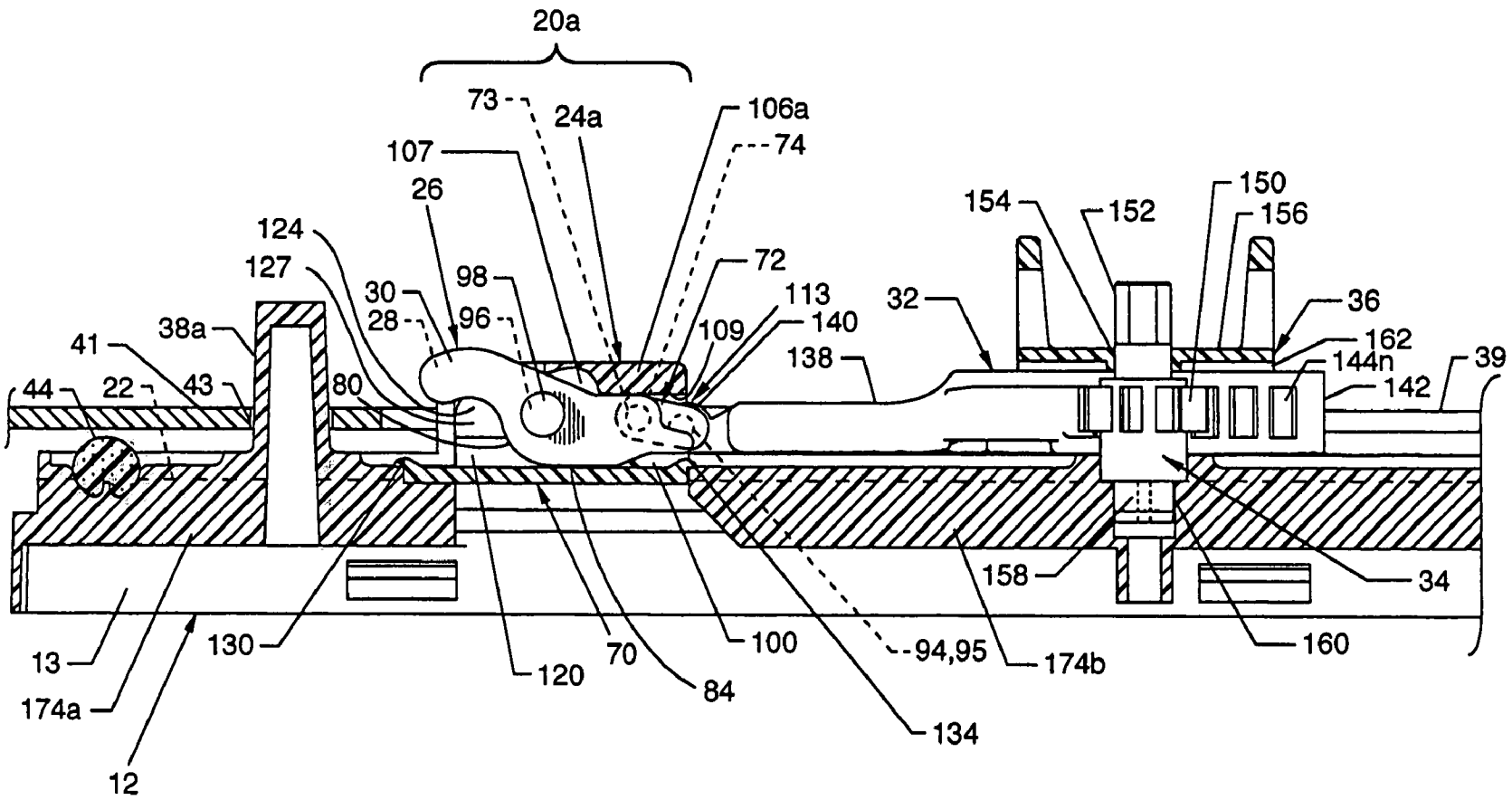
FIG. 14 is a view like FIG. 11 but showing the components fully assembled and also showing a portion of a mounting panel assembly to which the main housing as well as all other parts associated therewith are to be attached.
Figure 15:
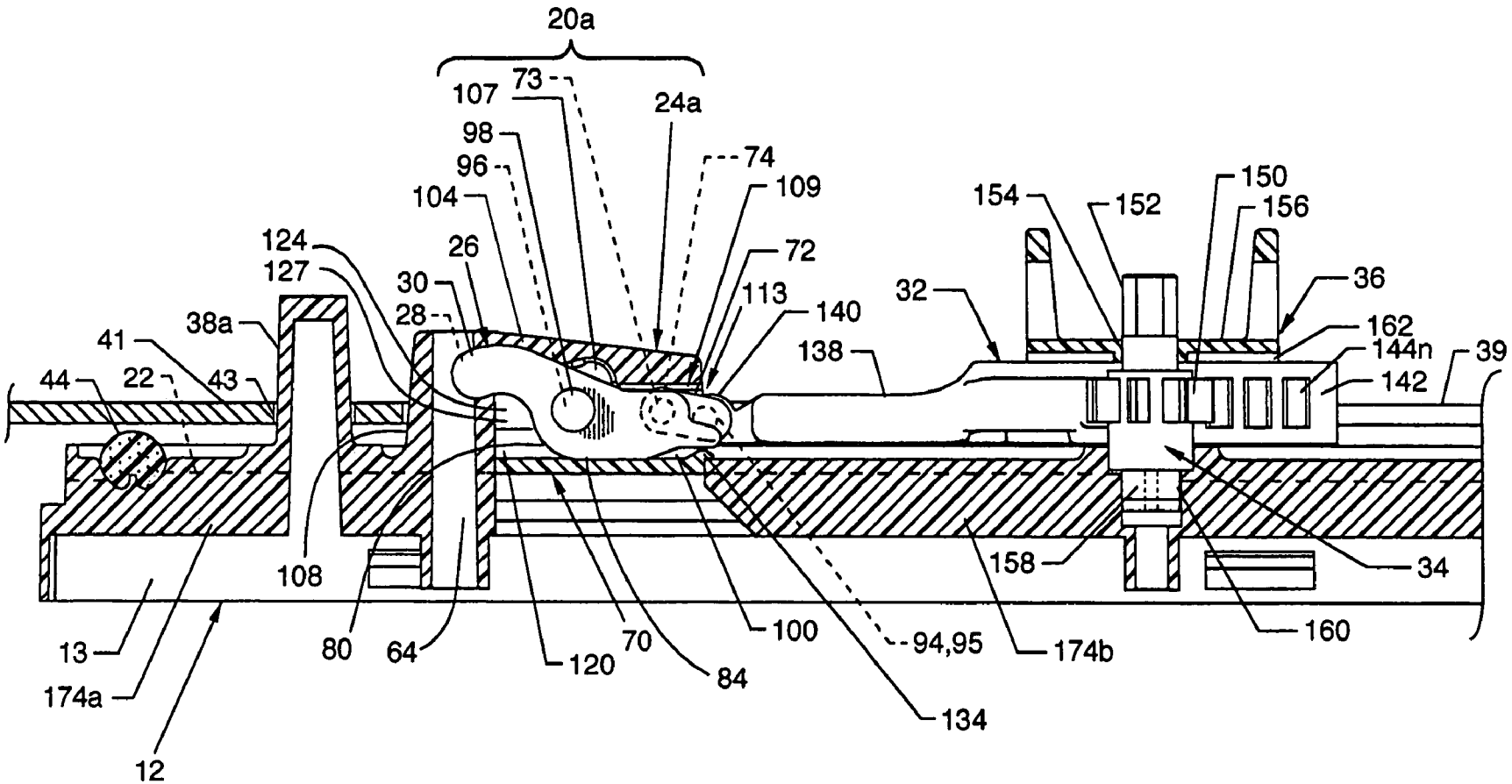
FIGS. 15, 16 and 17 are views showing in sequence the various stages of the process involving attachment of the main housing and associated parts to a portion of the mounting panel assembly; and, FIG. 18 is a plan view showing the outboard latch arm and the inboard latch arm engaged over and about a tab at the junction of a vertical plate and a horizontal plate of a mounting panel assembly.
Figure 16:
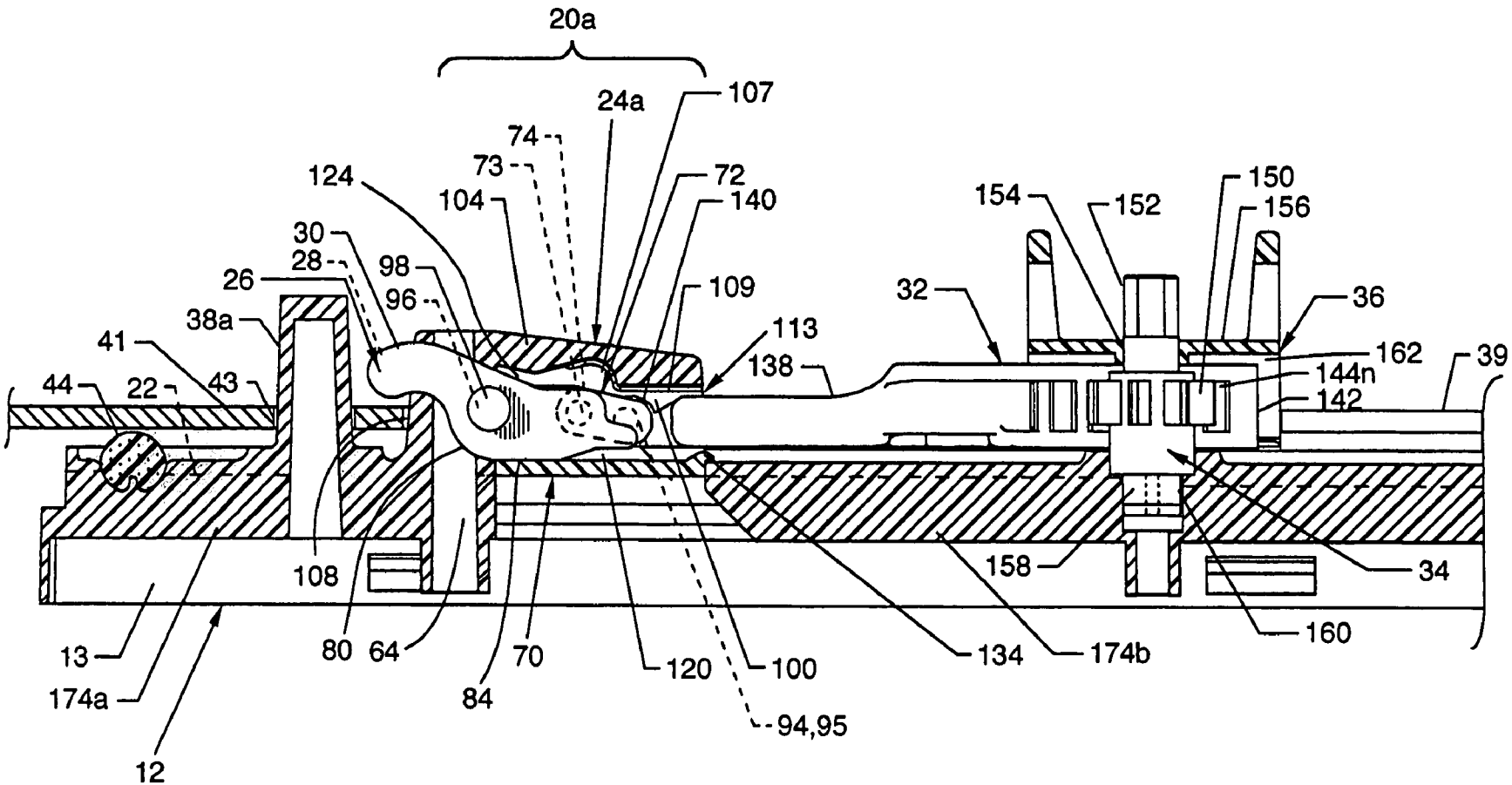

FIGS. 13–17 illustrate the process incorporating use of the electronic display module having a four-point latching system 10 into an electronic sign where FIG. 14 is a view of the main housing 12 showing a portion thereof in cross section like FIG. 11 but showing the components fully assembled, and where FIGS. 15, 16 and 17 are views like FIG. 13 showing in sequence the various stages of the process involving attachment of the main housing 12 and associated parts to a portion of the mounting panel assembly 39, such as shown in FIG. 18. FIG. 18 is a plan view showing the outboard latch arm 28 and the inboard latch arm 30 engaged over and about the tab 41 at the junction of the vertical plate 39*a* and the horizontal plate 39*c* of the mounting panel assembly 39. Although operation of only one of the latching points, such as illustrated by the latch mechanism 20*a*, is described, operation of the remaining latch mechanisms 20*b*, 20*c* and 20*d* is the same as described for the latch mechanism 20*a*.

The process shown in FIGS. 13, 14, 15, 16 and 17 involving the attachment of the electronic display module having a four-point latching system 10 to the mounting panel assembly 39 is best understood by first perusing the simple installation process where the process includes the steps of:

1. Rotating the actuator gears 34 to ensure full retraction of the latches 26 towards the actuator gears 34;
2. Positioning and aligning the locator posts 38*a*–38*d* of the main housing 12 with alignment holes 43 of the mounting panel assembly 39 and bringing the main housing 12 into contact with the mounting panel assembly 39;
3. Rotating the actuator gears 34 to position the outboard latch arms 28 and the inboard latch arms 30 over tabs 41 of the mounting panel assembly 39; and,
4. Continuing rotation of the actuator gears 34 to rotationally position the outboard latch arms 28 and the inboard latch arms 30 against the tabs 41 of the mounting panel assembly 39.

In FIGS. 14 and 15, each figure shows the same positioning of the latch 26 and the components connected thereto; and with respect to process step 1 above, elements of the invention are shown assembled as previously described, whereby the greater portion of latch 26 is residing in the cavity 118 (FIG. 9) of the latch housing 24*a* in a retracted position. Such positioning places the latch 26 toward the actuator gear 34, and the outboard and inboard latch arms 28 and 30 remain in a position which would not have interfered with the alignment of the main housing 12 with the tab 41 of the mounting panel assembly 39. Also shown is the shaft 158 of the actuator gear 34 in supportive engagement with the support hole 160 of panel 22 and the shaft 152 in supportive engagement with the support hole 154 of the gear support housing 36 which engages the panel 22. The actuator gear 34 is shown in engagement with the actuator arm 32 which is attached to the latch 26 by the linkage 72. Although not shown, the actuator gear 34 also engages an actuator arm 32 connected with the latch mechanism 20*b* (FIG. 1) for simultaneous operation of latch mechanisms 20*a* and 20*b*.

When the locator posts 38*a*–38*d* are aligned with alignment holes 43 of the mounting panel assembly 39 and the main housing 12 is brought into contact with the mounting panel assembly 39, the actuator gear 34 is actuated to initially urge the actuator arm 32, the linkage 72 and the latch 26 in a direction towards the tab 41 of the mounting panel assembly 39 to a position as shown in FIG. 16.

The latch 26 is guided within the cavity 118 (FIG. 9) of the latch housing 24*a* by various components, surfaces, protuberances and the like. The outboard post and the inboard post 96 and 98, respectively, of the latch 26 align in and are guided in part by the outboard and inboard slots 127 and 129 to guide the latch 26 while transiting the cavity 118 where the cavity 118 is bounded by the latch housing 24*a* and the latch lock plate 70.

The planar surface 109 and the recess 107 also lend to the guidance and orientation of the latch 26, as well as the linkage 72. Initially, as shown in FIGS. 14 and 15 and with respect to process step 3, as the actuator arm 32 urges the latch 26 towards the tab 41, the attachment fixture 74 including the central attachment fixture 74*a* and the outboard and inboard attachment fixtures 74*b* and 74*c* are in guided and stabilized contact with the planar surface 109. Force is transmitted from the actuator arm 32 to the latch 26 by the linkage 72 where the first and second axes centers of pivotal rotation 178 and 182 of the linkage 72 are distanced and prohibited from achieving an overcenter relationship (i.e, an almost straight line push force is maintained across the linkage 72). The orientation of the linkage 72 is maintained in a position nearly parallel to the force being exerted thereupon and to the planar surface 109 by the sliding contact of the entire attachment fixture 74 with the planar surface 109 and as such during such actuation, the orientation of the latch 26 and the linkage 72 is constrained and restricted with respect to orientation, as shown in FIGS. 14 and 15.

As the latch 26 is continually advanced, the latch 26 achieves a position where the outboard and inboard latch arms 28 and 30 are positioned over and about the tab 41, such as shown in FIG. 16. At this conjuncture and with respect to process step 4 above, the attachment fixture 74 discontinues an intimate contactual relationship with and is no longer influenced by the planar surface 109, and the outboard and the inboard posts 96 and 98 reach the end of travel within and against the ends of the outboard and inboard slots 127 and 129. Continued movement of the actuator arm 32 exerts force against the linkage 72 and the latch 26. As the longitudinal movement of the latch 26 is discontinued, the only movement of the latch 26 which can take place is rotational movement about the outboard and inboard posts 96 and 98 positioned at the ends of the outboard and inboard slots 127 and 129 where such rotational movement is urged by the force applied longitudinally by the actuator arm 32 and the linkage 72. Whereas the second axis of pivotal rotation 182 is to the rearward of the first axis of pivotal rotation 178, the force applied to the linkage 72 causes the linkage 72 to be repositioned angularly where the rounded crossmember pivot bar 73, pivot pins 81 and 83, and pivotally connected attachment fixture 74 of the latch 26 (second axis of pivotal rotation 182) are urged rearwardly to be positioned in and to be accommodated by the recess 107 to a position as shown in FIG. 17. At the same time, the attachment fixture 140 is accommodated by the recess 90 in the latch 26 and the portions of the links 75 and 77 are accommodated by the slots 86 and 88 in the latch 26. Such forceful repositioning urges the outboard and inboard latch arms 28 and 30 towards the panel 22 and against the interceding tab 41 of the mounting panel assembly 39. Such forceful repositioning also provides a locking of the first axis of pivotal rotation 178 overcenter and slightly past the second axis of pivotal rotation 182 to maintain the rotated position of the latch 26 in the locked position against the mounting panel assembly 39.

Disengagement of the electronic display module having a four-point latching system 10 from the mounting panel assembly 39 is accomplished by actuating the actuator gears 34 in a reverse manner to cause re-orientation and movement of the actuator arm 32 towards the actuator gears 34 to reposition the linkage 72 from the overcenter locked position to disengage the outboard and inboard latch arms 28 and 30 from intimate contact with the tab 41 of the mounting panel assembly 39. The actuator gears 34 are further actuated in a reverse manner to retract the latch 26 from a position where the outboard and inboard latch arms 28 and 30 are overlying the mounting panel assembly 39. The linkage 72 during retraction assumes a position where the relationship of the first axis of pivotal rotation and the second axis of pivotal rotation does little to stabilize the orientation of the latch 26 during retraction. Stabilization of the latch 26 during retraction is influenced by the planar bottom surfaces 82 and 84 riding along the upper surface of the latch lock plate 70.

Various modifications can be made to the present invention without departing from the apparent scope thereof.

Electronic Display Module Having a Four-Point Latching System for Incorporation into an Electronic Sign and Process Parts List

10 electronic display module having a four-point latching system
12 main housing
13 peripheral wall
14 driver board
16 louver panel
18 LED display panel
20*a–d* latch mechanisms
22 panel
24*a–d* latch housings
26 latch
28 outboard latch arm
30 inboard latch arm
32 actuator arm
34 actuator gear
36 gear support housing
38*a–d* locator posts
39 mounting panel assembly
39*a–b* vertical plates
39*c–d* horizontal plates
40*a–e* louver panel attachment pins
41 tab
42*a–d* drive board attachment pins
43 alignment hole
44 seal
46*a–e* body holes
48*a–n* connectors
50*a–n* connectors
52 access hole
54 access hole
56 access hole
58 access hole
60*a–d* body holes
62 body hole
64 body hole (latch housing)
66 body hole
68*a–d* cutouts
70 latch lock plate
72 linkage
73 rounded cross-member pivot bar
74 attachment fixture
74*a* central attachment fixture
74*b* outboard attachment fixture
74*c* inboard attachment fixture
75 link
76 interlatch space
77 link
78 radiused curve
80 radiused curve
81 pivot pin
82 planar bottom surface
83 pivot pin
84 planar bottom surface
85 slot
86 slot
87 slot
88 slot
90 recess
92 slot
94 pivot pin
95 pivot pin
96 outboard post
98 inboard post
100 outboard sidewall
102 inboard sidewall
104 guide body
106*a–b* top walls
107 recess
108 louver pin receptor post
109 planar surface

110 outboard slot
112 inboard slot
113 opening
114 main panel
116 cutout
118 cavity
120 outboard retainer bar
122 inboard retainer bar
124 outboard configured cavity
126 inboard configured cavity
127 outboard slot
128 cutout
129 inboard slot
130 retainer catch
132 retainer catch
134 retainer catch
136 retainer catch
138 actuator arm main body
140 attachment fixture
142 actuator arm gear receptor
144*a–n* gear receptor cavities
146 pivot hole
150 gear
152 shaft
154 support hole
156 central panel
158 shaft
159 receptacle hole
160 support hole
162 panel
164 panel
166 retainer catch
168 retainer catch
170 outboard slot
172 inboard slot
174*a–n* support struts
176 longitudinal travel path
178 first axis of pivotal rotation
180 longitudinal travel path
182 second axis of pivotal rotation It is claimed:

1. A latch mechanism incorporated with an electronic display module comprising:

a. a latch housing formed on a panel of the electronic display module;

b. a latch lock plate mounted to the latch housing, the latch housing and the latch lock plate together bounding a cavity; and, c. a latch, the latch being moveable within the cavity and being guided by the cavity along a latch pathway from a retracted position through an intermediate position to an engaged position, the latch pathway following a linear path between the retracted position and the intermediate position and a rotational path between the intermediate position and the engaged position.

2. The latch mechanism of claim 1, wherein the latch has a body with at least one latch arm on a first end, an attachment fixture on a second end, and opposed posts in a central region.

3. The latch mechanism of claim 2, wherein the cavity includes a pair of opposed slots, the opposed slots being aligned and receiving the opposed posts of the latch.

4. The latch mechanism of claim 2, wherein the latch body has a pair of latch arms, and wherein the latch housing includes slots from which the pair of latch arms extend when the latch is in the intermediate position and when the latch is in the engaged position.

5. The latch mechanism of claim 2, further including a link pivotally connected to the attachment fixture.

6. The latch mechanism of claim 5, wherein the cavity is configured and dimensioned to constrain motion of the link during movement of the latch between the retracted position and the engaged position, but to allow the link to assume an overcenter relationship with the attachment fixture when the latch is in the engaged position.

7. The latch mechanism of claim 6, further comprising an actuator arm, the actuator arm having a first end and a second end, and wherein the link is pivotally attached to the first end of the actuator arm.

8. The latch mechanism of claim 7, wherein the second end of the actuator arm is driven by a gear and the gear is carried by a shaft.

9. The latch mechanism of claim 8, wherein the gear is driven by rotating the shaft.

10. The latch mechanism of claim 9, wherein the shaft driving the gear may be rotated in a first direction to place the link in an overcenter relationship with the latch thereby placing the latch in the engaged position and wherein the shaft may be rotated in a second direction, opposite to the first direction, such that the link is released from the overcenter relationship with the latch and the latch is moved from the engaged position to the intermediate position and then to the retracted position.

11. The latch mechanism of claim 10, further comprising:

a. a second latch housing formed on the panel of the electronic display module;

b. a second latch lock plate mounted to the second latch housing, the second latch housing and the second latch lock plate together bounding a second cavity;

c. a second latch, the second latch having a body with at least one latch arm on a first end, an attachment fixture on a second end, and opposed posts in a central region and being moveable within the second cavity and being guided by the second cavity along a second latch pathway from a second retracted position through a second intermediate position to a second engaged position, the second latch pathway following a second linear path between the second retracted position and the second intermediate position and a second rotational path between the second intermediate position and the second engaged position;

d. a second link pivotally connected to the attachment fixture on the second latch; and, e. a second actuator arm, the second actuator arm having a first end and a second end, the second link being pivotally attached to the first end of the second actuator arm, and the second end of the second actuator arm being driven by the gear.

12. The latch mechanism of claim 11, wherein the first latch and the second latch are situated in mirror imagelike arrangement, such that both latches are simultaneously in the same respective positions and both latches move simultaneously toward or away from the gear.

13. The latch mechanism of claim 11, wherein a gear support housing carries the gear and guides the first and second actuator arms.

14. The latch mechanism of claim 7, wherein the actuator arm is guided by a support housing.

15. The latch mechanism of claim 14, wherein the support housing is adjacent to the second end of the actuator arm.

16. The latch mechanism of claim 15, wherein the support housing further carries a gear and the actuator arm is driven by the gear.

17. A main housing for an electronic display module comprising:

a. a panel;

b. a peripheral wall bounding the panel;

c. a plurality of latch mechanisms located on the panel adjacent the peripheral wall, each of the latch mechanisms including a latch housing and a latch moveable within the latch housing, the latch moveable along a latch pathway following a linear path between a more compact retracted position and an intermediate position and a rotational path between the intermediate position and an extended engaged position, the latch having at least one latch arm, the latch arm moving with the latch between the extended engaged position and the more compact retracted position; and, d. at least one actuator system, the at least one actuator system being capable of simultaneously moving at least two of the latches of the plurality of latch mechanisms between the extended engaged position and the more compact retracted position for each latch being moved.

18. The main housing of claim 17, wherein the at least one actuator system simultaneously moves two latches and the two latches are arranged as mirror images.

19. The main housing of claim 17, wherein the panel has two pairs of latch mechanisms, the latch mechanisms of each pair being in a mirror imagelike arrangement to each other, and two actuator systems, each actuator system of the two actuator systems being capable of simultaneously moving the latches of one of the pairs of latch mechanisms.

20. The main housing of claim 19, wherein the panel is substantially rectangular in shape and the peripheral wall is substantially rectangular in shape, the main housing having four corners and four sides.

21. The main housing of claim 20, wherein the latch mechanisms of a pair of latch mechanisms are located adjacent to each of two adjacent corners, and the actuator system for moving the latches of that pair is located adjacent to the side connecting the two adjacent corners.

22. The main housing of claim 21, wherein the latches of that pair when moved move substantially parallel to the side connecting the two adjacent corners.

23. The main housing of claim 22, wherein each actuator system includes a pair of actuator arms, each of the actuator arms being connected to a latch of one of the latch mechanisms.

24. The main housing of claim 23, wherein both the actuator arms of an actuator system are carried by a single support housing.

25. The main housing of claim 24, wherein the support housing includes a gear, the gear being interposed between the actuator arms and simultaneously driving the actuator arms in opposite directions.

26. The main housing of claim 25, wherein the gear is mounted on a shaft.

27. The main housing of claim 26, wherein the gear is driven by the shaft.

28. The main housing of claim 27, wherein the main housing has a front side and a rear side and the shaft may be rotated from the front side or the rear side.

29. The main housing of claim 28, wherein the shaft may be rotated from both the front side and the rear side.

30. The main housing of claim 27, wherein the shaft has an end suitably shaped for rotation by a complementary suitably shaped tool.

31. The main housing of claim 17 in combination with a driver board secured to the panel.

32. The main housing of claim 17 in combination with an LED display panel secured to the panel.

33. The main housing of claim 17 in combination with a louver panel secured to the panel.

34. The main housing of claim 17, in combination with:

a. a louver panel secured to the panel; and, b. an LED panel interposed between the louver panel and the panel.

35. The main housing of claim 17, in combination with:

a. a louver panel secured to the panel on the front side of the panel;

b. an LED panel interposed between the louver panel and the panel; and, c. a driver board secured to the panel on the back side of the panel.

36. The main housing of claim 17 in combination with a mounting panel assembly, the mounting panel assembly being adapted to accept the main housing, such that the latches of the main housing engage the mounting panel assembly in the engaged position and allow the main housing to disengage from the mounting panel assembly in the retracted position.

37. The combination of claim 36, wherein the mounting panel assembly has a tab to be engaged by a latch arm in the engaged position.

38. The combination of claim 37, wherein the tab has an alignment hole and the main housing has a locator post, the locator post facilitating alignment of the housing with the mounting panel assembly.

39. The combination of claim 38, wherein each latch has a pair of latch arms, the pair of latch arms of a latch engaging the tab on opposite sides of the locator post when the locator post is inserted in the alignment hole and the latch is in the engaged position.

40. The combination of claim 39, wherein the latch arms allow the locator post to be removed from the alignment hole in the retracted position, such that the main housing may be separated from or aligned to the mounting panel assembly when the latch arms are retracted.

41. A process for attaching a housing to a mounting panel assembly in an electronic sign comprising the steps of:

a. providing a housing and a mounting panel assembly, the housing being complementary to the mounting panel assembly and having a four-point latching system which includes latches actuatable in pairs by an actuator gear for each pair, each of the latches having inboard and outboard latch arms, the housing further having locator posts, and the mounting panel assembly having tabs with alignment holes for accepting the locator posts;

b. rotating the actuator gears to ensure full retraction of the latches towards the actuator gears;

c. positioning and aligning the locator posts with the alignment holes of the mounting panel assembly and bringing the housing into contact with the mounting panel assembly;

d. rotating the actuator gears to position the outboard latch arms and the inboard latch arms over the tabs of the mounting panel assembly; and, e. continuing rotation of the actuator gears to rotationally position the outboard latch arms and the inboard latch arms against the tabs of the mounting panel assembly.

42. In combination, an electric sign comprising:

a. a mounting panel assembly having a series of vertical plates and a series of horizontal plates, tabs at junctions of vertical plates, and horizontal plates and an alignment hole in each tab, together defining a plurality of alignment and attachment positions;

b. a plurality of electronic display modules, each of the electronic display modules having locator posts and a latch system for alignment and attachment to the alignment and attachment positions of the mounting panel assembly, and wherein each of the electronic display modules includes:

(1) a panel;

(2) a peripheral wall bounding the panel;

(3) a plurality of latch mechanisms located on the panel adjacent the peripheral wall, each of the latch mechanisms including a latch housing and a latch moveable within the latch housing, the latch moveable along a latch pathway following a linear path between a more compact retracted position and an intermediate position and a rotational path between the intermediate position and an extended engaged position, the latch having at least one latch arm, the latch arm moving with the latch between the extended engaged position and the more compact retracted position; and, (4) at least one actuator system, the at least one actuator system being capable of simultaneously moving at least two of the latches of the plurality of latch mechanisms between the extended engaged position and the more compact retracted position for each latch being moved; and, c. wherein, when the latches are in the more compact retracted position, the electronic display module may be aligned with the mounting panel assembly such that the locator posts may be inserted into the alignment holes and then the actuator system employed to simultaneously move the latches to the extended engaged position thereby attaching the electronic display module to the mounting panel assembly.

* * * * *